US010098416B1

(12) United States Patent
Harvey et al.

(10) Patent No.: US 10,098,416 B1
(45) **Date of Patent: *Oct. 16, 2018**

(54) ACCESSORIES AFFIXED TO FOOTWEAR OR AFFIXED AROUND FOOTWEAR TO PROVIDE A DECORATIVE FASHION ATTACHMENT

(71) Applicant: Setu Doshi, Walnut, CA (US)

(72) Inventors: Gloria Harvey, Lynwood, WA (US); Setu Doshi, Walnut, CA (US)

(73) Assignee: A1 Jewellery, Inc., Walnut, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/331,705

(22) Filed: Oct. 21, 2016

Related U.S. Application Data

(63) Continuation-in-part of application No. 14/802,608, filed on Jul. 17, 2015, now Pat. No. 9,955,753.

(51) Int. Cl.
*A43B 23/24* (2006.01)

(52) U.S. Cl.
CPC ..... *A43B 23/24* (2013.01)

(58) Field of Classification Search
CPC ..... A43B 3/0078; A43B 3/24
See application file for complete search history.

(56) References Cited

U.S. PATENT DOCUMENTS 1,273,376 A * 7/1918 Jones ..... A43B 3/0078 2/245
D81,405 S * 6/1930 Riker ..... D2/976
1,855,345 A * 4/1932 Fischer, Jr. ..... A43C 11/22 36/58.5
2,461,977 A * 2/1949 Gilmour ..... A43B 3/0078 24/507
2,616,189 A * 11/1952 Smith ..... A43B 3/0078 36/1
2,759,284 A * 8/1956 Santisi ..... A43B 3/24 36/11.5
2,871,602 A * 2/1959 Uldall ..... A43B 3/0078 36/1
3,878,641 A * 4/1975 Noble ..... A63H 5/00 36/139
4,026,047 A * 5/1977 Ahmer ..... A43B 3/0078 2/245
D269,600 S 7/1983 Mox
5,496,612 A * 3/1996 Ransbottom ..... A43B 3/0078 2/245

(Continued)

FOREIGN PATENT DOCUMENTS

WO WO2010014972 2/2010

*Primary Examiner* — Richale Quinn
(74) *Attorney, Agent, or Firm* — Thomas I. Rozsa

(57) ABSTRACT

An attachment member which enables a decorative ornament to be affixed either onto a shoe, preferably at a location were a decorative ornament retained on the invention can be visible and cover at least a portion of the shoe and also a portion of the heel of the shoe. It is also a decorative ornament which can be placed around the instep location of a boot or elongated footwear where the decorative ornament can be removably affixed around the instep location of the footwear and has decorative ornaments dangling from the present invention to enable them to be visible on the boot. The addition is an improved bracket to retain the decorative ornament securely on a shoe with at least two bracket retaining arms.

12 Claims, 21 Drawing Sheets

(56) References Cited

U.S. PATENT DOCUMENTS

| | | | | |
|---|---|---|---|---|
| D407,555 | S * | 4/1999 | Sorofman | D2/642 |
| 7,328,528 | B2 * | 2/2008 | Caminiti | A43B 3/0078 2/244 |
| 7,891,117 | B2 * | 2/2011 | Sack | A43B 23/24 36/1 |
| D659,376 | S * | 5/2012 | John | D2/946 |
| 8,667,712 | B2 * | 3/2014 | Baum | A43B 1/0027 36/100 |
| 8,991,077 | B1 * | 3/2015 | Shapiro | A43B 23/02 24/712 |
| 2006/0010573 | A1 * | 1/2006 | Habert | A41B 11/001 2/237 |
| 2009/0107011 | A1 | 4/2009 | Klooster et al. | |
| 2010/0058619 | A1 * | 3/2010 | Ferrante | A43B 3/126 36/136 |
| 2010/0307031 | A1 * | 12/2010 | Granito | A43B 3/0078 36/136 |
| 2012/0174442 | A1 | 7/2012 | Castle | |
| 2013/0025164 | A1 | 1/2013 | Euresti et al. | |
| 2014/0215859 | A1 * | 8/2014 | Leo | A43B 23/24 36/136 |

* cited by examiner

ACCESSORIES AFFIXED TO FOOTWEAR OR AFFIXED AROUND FOOTWEAR TO PROVIDE A DECORATIVE FASHION ATTACHMENT

CROSS-REFERENCE TO RELATED APPLICATION

This application is a continuation-in-part of patent application Ser. No. 14/802,608 filed on Jul. 17, 2015, now pending.

BACKGROUND OF THE INVENTION

1. Field of the Invention

The present invention relates to the field of decorative fashion accessories either removably affixed to footwear, removably affixed around footwear, permanently affixed to footwear or permanently affixed around footwear.

2. Description of the Prior Art

Women typically wear scarves, hats, belts, rings, earrings, necklaces, wrist bands and other accessories to change their wardrobes or make a fashion statement. Usually, the accessories include clasps, buckles, snaps, etc. that enable them to be securely attached to a particular piece of clothing. The accessories are also normally worn at a location where the accessory or accessories are easily visible.

Footwear is considered to be a fashion accessories by all people, especially women. Footwear may be made in different styles such as shoes with heels of varying heights, shoes which are flat, boots, loafers, sandals, and tennis shoes. Shoes may also be made out of different materials and colors. Shoes may also include different styles of clasps, straps and buckles. Users typically do not wear jewelry or other objects attached to the outside surfaces of the footwear because the jewelry or other objects can be easily dislodged.

The inventor of the present application and the owner of the assignee of the present invention are both aware of the following fifteen (15) prior art issued patents and published patent applications which are relevant to the present invention:

1. U.S. Pat. No. 1,273,376 issued to Le Roy F. Jones on Jul. 23, 1918 for "Detachable Bow Support for Shoes" (hereafter the "Jones Patent");
2. U.S. Pat. No. 2,871,602 issued to Faith H. Uldall on Feb. 3, 1959 for "Heel Ornament Mounting Band for Women's Shoes" (hereafter the "Uldall Patent");
3. U.S. Pat. No. 4,026,047 issued to Joseph C. Ahmer et al. on May 31, 1977 for "Decorative Device for Converting Street Shoes to Dress Shoes" (hereafter the "Ahmer Patent");
4. U.S. Pat. No. 5,496,612 issued to Jayne M. Ransbottom on Mar. 5, 1996 for "Shoe Adornment" (hereafter the "Ransbottom Patent");
5. U.S. Pat. No. 7,328,528 issued to Holly Caminiti on Feb. 12, 2008 for "Removably Attachable Decoration for Footwear" (hereafter the "Caminiti Patent");
6. United States Published Patent Application No. 2009/0107011 to John H. Klooster et al. on Apr. 30, 2009 for "System and Method for Securing Accessories to Clothing" (hereafter the "Klooster Published Patent Application");
7. United States Published Patent Application No. 2010/0058619 to Stacy Ferrante et al. on Mar. 11, 2010 for "Sandal with Charms Suspended in Fluid and Attachable Charms" (hereafter the "Ferrante Published Patent Application");
8. United States Published Patent Application No. 2010/0307031 to Mario Granito on Dec. 9, 2010 for "Footwear Fitment" (hereafter the "Granito Published Patent Application");
9. United States Design Patent No. D629,600 issued to Neetan Mandalia on Dec. 28, 2010 for "Shoe Heel Clip" (hereafter the "Mandalia Design Patent");
10. United States Design Patent No. D659,376 issued to Colleen S. John on May 15, 2012 for "Jewelry Attachment for Footwear" (hereafter the "John Design Patent");
11. United States Published Patent Application No. 2012/0174442 to Wanda Marie Castle on Jul. 12, 2012 for "Decorative Boot Clip" (hereafter the "Castle Published Patent Application");
12. United States Published Patent Application No. 2013/0025164 to Rene Euresti et al. on Jan. 31, 2013 for "Method and Articles for Adornment of Footwear" (hereafter the "Euresti Published Patent Application");
13. U.S. Pat. No. 8,667,712 issued to Asher Baum on Mar. 11, 2014 for "Footwear Design Personalizing" (hereafter the "Baum Patent");
14. United States Published Patent Application No. 2014/0215859 to Susan Leo on Aug. 7, 2014 for "Shoe Charm Holder Device" (hereafter the "Leo Published Patent Application");
15. PCT Publication No. WO 2010/014972 to Michelle M. Juza et al. on Feb. 4, 2010 for "Apparatus, Method and System for Using Interchangeable Decorative Elements with Footwear" (hereafter the "Juza PCT Publication").

The Jones Patent discloses a plate which is affixed to the front of the shoe as illustrated in FIG. 1 and then the plate itself has keyholes and the ornament such as bow, has mating keyholes that fit into the opening of the inner slit to be retained in the narrow portion of the keyhole.

The Uldall Patent discloses a band to which the ornaments are affixed but the band effectively is a spring mechanism which is retained on the interior of the shoe which is adjacent the heel by a spring force which causes the band to go against the interior of the heel and then decorative items can be affixed to the band. The concept of the prongs as shown in the provisional patent application is not disclosed in this patent.

The Ahmer Patent discloses a decorative device for converting street shoes to dress shoes. In this embodiment a flexible connector is wrapped around the heel of the shoe then it is stretched so that brackets go around the back of the heel to affix the mounting bracket to the shoe. Decorative items are then affixed to this attachment. The method by which the bracket is affixed to the shoe, which as best illustrated in FIGS. 3 and 4, is a portion that is wrapped around the heel of the shoe and then has an extended section which has two tabs that go around the upper end of the back of the shoe and then the decorative items are affixed at the location between the portion that is wrapped around the heel of the shoe and the two tabs that retain the entire device onto the back of the shoe.

The Ransbottom Patent discloses a band which wraps around the shoe, usually in the front of the shoe, and then has wires around it and the decorative ornament has an attachment mechanism which is affixed to the band by affixation members.

The Caminiti Patent discloses an elastic band that is wrapped around a portion of the shoe and then has a pair of hook members which are affixed to locations on the decoration which receives the hook members to enable the decoration to be affixed to the shoe through the elastic band being wrapped around the shoe. The band can be wrapped around different locations of the shoe but the fundamental principle is that the band is wrapping around the portion of the shoe and then is affixed by hook members that wrap around the band and then are hooked onto the ornament to be retained.

The Klooster Published Patent Application discloses a strap which went from one side of the shoe to the other side of the shoe with a closing member that would go over the strap to close one portion of the strap over the other portion of the strap to effectively have the shoe which primarily was a sandal securely affixed to the person's foot. The innovation as it relates to the present invention is that there were decorative accessories affixed to the strap with a member from the accessory that went under the strap and therefore when then top strap under which the attaching member was located was affixed securely to the opposite side of the strap, the decoration which was affixed to the attaching member sat on top of the upper strap and was held in place by the force of the upper strap section being affixed to lower strap section.

The Ferrante Published Patent Application discloses a strap affixed to a sandal where the decorative ornament would be placed around the strap or could be in a fluid within the strap.

The Granito Published Patent Application discloses a filament, which essentially is a piece of material which can be inserted inside the shoe and has extending from it a flat member, which extends outside the shoe and to which an ornament is affixed.

The John Design Patent discloses a pair of members with a hooked end where the hooked ends have openings by which members can be affixed onto the shoe through a threading of a bolt or screw. There is a strap member located between the two and an ornament can be affixed to the strap member.

The Castle Published Patent Application discloses a decorative boot clip. In this case, the decoration member wraps around the rim of the boot and decorations can extend from the exterior portion which is on the outside portion of the rim of the boot. The exterior portion can have decorations designed into it or affixed to it.

The Mandalia Design Patent discloses a pair of affixation members that are attached on opposite sides of the shoe and go around the outside of the shoe with a third member in the middle to which a decorative ornament would be attached and extending behind the back of the shoe.

The Euresti Published Patent Application discloses having a fastening member that snaps onto a location of a shoe and can also have a pair of fastening members with a chain between them onto which a decorative element is affixed.

The Baum Patent discloses permanently attaching a member to a location on the shoe, including the side of the shoe or the back of the shoe, and then having an interlocking member which locks with the attaching member to which ornaments are attached. However, the base member is permanently affixed into the shoe and the locking member is a mating member which has prongs that are offset from the portion that is affixed to the shoe so that they can be interlocked together and to which the designs can be attached.

The Leo Published Patent Application discloses a shoe charm holder. The holder is affixed to the bottom of the shoe at the location between the heel of a high heel shoe and the base portion where the bottom of the women's foot rests and the decoration is affixed at that location between the interior of the heel and the interior of the bottom of the shoe.

The Juza PCT Application is for an apparatus, method and system for using interchangeable decorative elements with footwear. The invention discloses methods for changing designs onto a shoe, primarily a sandal which has various strap members and other members, some of which are permanently affixed to the sandal others of which are removably affixed to which a decoration is attached.

There is a significant need for accessories affixed to footwear which is a substantial improvement and innovation over the items disclosed in the prior art.

SUMMARY OF THE INVENTION

The new and improved invention disclosed and claimed in this continuation-in-part patent application is entirely the invention of SETU DOSHI.

In one embodiment, the bracket and main band jewelry element are disposed around the rear, curved upper edge of the footwear. The bracket includes at least one perpendicular arm that extends upward from the bracket's upper edge. When assembling the bracket of the heel, each arm is manually folded over and pressed against the inside surface of the footwear to hold the bracket in place when the footwear is worn. Foam pads may also be attached to the end of each arm to provide comfort.

A second embodiment of the fashion accessory is configured to extend laterally around the instep region of the footwear. The jewelry element has two opposite brackets each attached to an end of a main band. Formed on the outside edge of each bracket is a row of teeth. The alternative embodiment of the present invention is a footwear fashion accessory that includes a thin, elongated bracket that holds a main bracket or strap-shaped jewelry element on the counter or instep region of the footwear. The jewelry element includes a main band and plurality of pendant decorative strings that are affixed to the main band and hang downwardly from the attachment bracket. In one embodiment, the bracket includes two connection tabs formed on opposite ends of the main band and a plurality of teeth formed on or attached to the bracket's lower edge. During assembly, the main band of the jewelry element is aligned over the inside surface of the bracket. The connection tabs engage the main band and attach the bracket to the main band. The jewelry elements are attached to a front face of the bracket and hang down from the front face of the bracket within an opening between two respective gaps. A clasp or buckle attached to the bracket or attached to the jewelry element at a location on the jewelry element holds the fashion accessory together in place and when the clasp is opened, the fashion accessory can be retained around the instep region of the footwear.

In one embodiment, the jewelry is disposed around the rear, curved upper edge of the footwear. The jewelry includes at least one perpendicular arm that extends upward from the bracket's upper edge. Each arm is manually folded over the upper edge and pressed against the inside surface of the footwear to hold the bracket in place when the footwear is worn. Optional foam pads may be attached to the end of each arm to provide comfort. Alternatively, the cushioning member can cover the entire attachment member. At least a portion of the attachment member is covered with a cushioning member.

In a second embodiment, the jewelry is designed to be worn around the instep region of the footwear. The jewelry includes a jewel element with its two opposite ends attached to two brackets each with end tabs and with teeth. During assembly, the jewelry element extends around the instep region of the footwear and a clasp is used to connect the jewelry element together to hold the jewelry element securely on the footwear.

An important element of the invention is the bracket which serves as the foundation/frame that holds the jewels and the bracket clips and slides on and off the footwear.

The footwear fashion accessory can be composed of any metal, plastic or non-porous material, preferably aluminum or precious metal.

By way of example, the accessory can be 1 to 6 inches in length, preferably 5¼ inches and ⅜ inch in width, with three edges bent at 90 degrees to create a one inch bend The bottom edge is spliced to retain grooves (for example 44 teeth) to hold jewels in place, 0 to 4 prongs along the top edge preferably three at 1 inch in length and two at ⅜ inch wide and one at ⅛ inch wide. Foam rubber slides over prongs to create a pad. The prongs are bent at 90 degrees and them molded to fit onto footwear.

It is an object of the present invention to provide a footwear fashion accessory that includes a thin, elongated bracket with two tabs formed on its opposite ends, a plurality of teeth formed or attached to the lower edge of the bracket, and a decorative jewelry element that attaches to the outside surface of the bracket and between two teeth. In one embodiment, the jewelry is disposed around the rear, curved upper edge of the footwear and includes at least one perpendicular arm that extends upward from the bracket's upper edge. Each arm is manually folded over and pressed against the inside surface of the footwear to hold the bracket in place when the footwear is worn. Foam pads may be attached to the end of each arm to provide comfort. In a second embodiment, the jewelry element with its two opposite ends have two attached brackets with teeth at opposite ends. The jewelry element extends around the instep region of the footwear and a clasp is used to connect the jewelry element together.

It is a further object of the present invention to provide an attachment mechanism by which a decorative member can be attached to the back of a shoe so that a decorative member or ornament can be affixed to the present invention which enables the present invention to be affixed by at least one or more attaching members affixed to the back of the shoe and at the same time enables the decorative members to hang down in an attractive manner so that the decorative members can be seen on the back of the shoe and on the heel of the shoe.

It is an additional object of the present invention to provide an apparatus which enhances the beauty of a shoe as an accessory which enables a decorative ornament to be affixed to the present invention apparatus which in turn can be removably affixed to a shoe at any location but preferably at the back of the shoe so that ornaments affixed to the present invention can dangle from the back of the shoe and from a location at the heel of the shoe.

The present invention is also an alternative decorative member wherein the present invention can be affixed to a strap member which can be removably affixed around the instep location of a boot to enable the decorative member to hang from the instant location of the boot and provide a decorative accessory attachment to the boot.

A third embodiment of the present invention is this continuation-in-part invention which is an improved main attaching member and decorative ornament retaining member (defined for the continuation-in-part invention as "bracket"). The bracket is formed in one piece including a main jewelry band having any desired given length from one inch to six inches, an elongated upper edge, an elongated lower edge, and a body between the elongated upper edge and the elongated lower edge. The body of the main jewelry band also has an interior surface and an exterior surface. The continuation-in-part third embodiment improved invention which is the improved bracket further includes a multiplicity of bracket retaining arms. It is within the spirit and scope of the present invention to have at least two bracket retaining arms and as many as twelve bracket retaining arms, although four bracket retaining arms is a preferred number. Each respective bracket retaining arm is formed in a shape of a downwardly pointing rounded tip with a "V"-shaped gap between the legs of the downwardly pointing tip, the gap extending for anywhere between 20 percent and 80 percent of the distance between the legs of each respective bracket retaining arm. The legs come together and form a combined structure leading to the lowermost rounded tip.

At its upper end, the legs are combined with an upper transverse joining section. The upper transverse joining section is integrally formed with a horizontal joining section which is integrally formed with a downwardly extending section which in turn is integrally formed with the main jewelry band at a location which extends from the lengthwise upper edge of the main band jewelry section into a portion of the body of the main band jewelry section. There is also a gap for each bracket retaining arm between each end of the downwardly extending section and the lengthwise upper edge and body of the main band jewelry section, except for each outermost bracket retaining arm at each respective end of the main jewelry band where each downwardly extending section of the outermost retaining arms ends at and is aligned with a respective outermost end of the main jewelry band.

The bracket retaining arms retain the improved bracket around the back of a shoe. It is within the spirit and scope of the present invention for the entire bracket section to be formed out of plastic or metal, with spring steel being the preferred metal. The "V"-shaped gap between the legs of each respective bracket retaining arm enhance the flexibility of each bracket retaining arm so it can fit inside a shoe in a secure way. It is within the spirit and scope of the present invention for each of the bracket retaining arms to be coated with resin to prevent abrasion to a woman's foot and/or heel.

In operation, the present invention improved bracket is inserted with the rear or interior surface of the body of the main jewelry band placed around the back of a woman's shoe. Each bracket retaining arm is placed into the interior of the woman's shoe by having each bracket retaining arm inserted so that the interior surface of the body of the main jewelry band rests against the rear of the shoe and each bracket retaining arm is inserted such that each of the integrally formed bracket retaining arms is inserted within the woman's shoe so that the upper portion of the woman's shoe is retained in the gap between the upper transverse joining section, the horizontal joining section and the integrally formed downwardly extending section so that the upper surface of the rear portion of the woman's shoe is trapped within this gap and each of the flexible bracket retaining arms are bent to accommodate the specific thickness of the rear portion of the woman's shoe and the heel and foot of the woman. In one example, the bracket retaining arms are inserted so that there are two on opposite sides of the woman's shoe spaced approximately 30 degrees apart.

The remaining innovations which contain the designs of the jewelry elements can be affixed to the exterior surface of the body of the main jewelry band by adhesive or other appropriate retaining members including mating hook and loop fasteners.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

Figure 18:
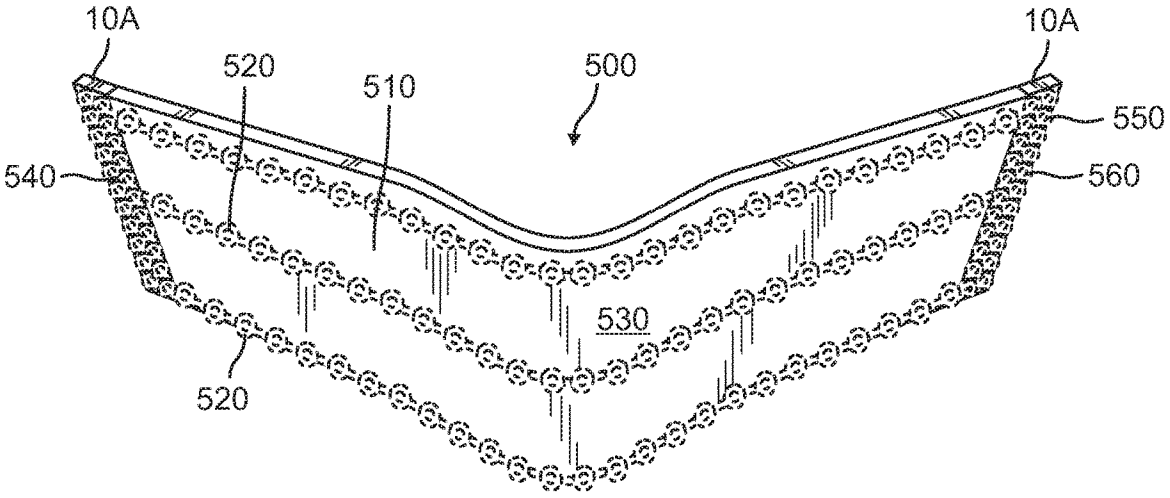
Figure 19:
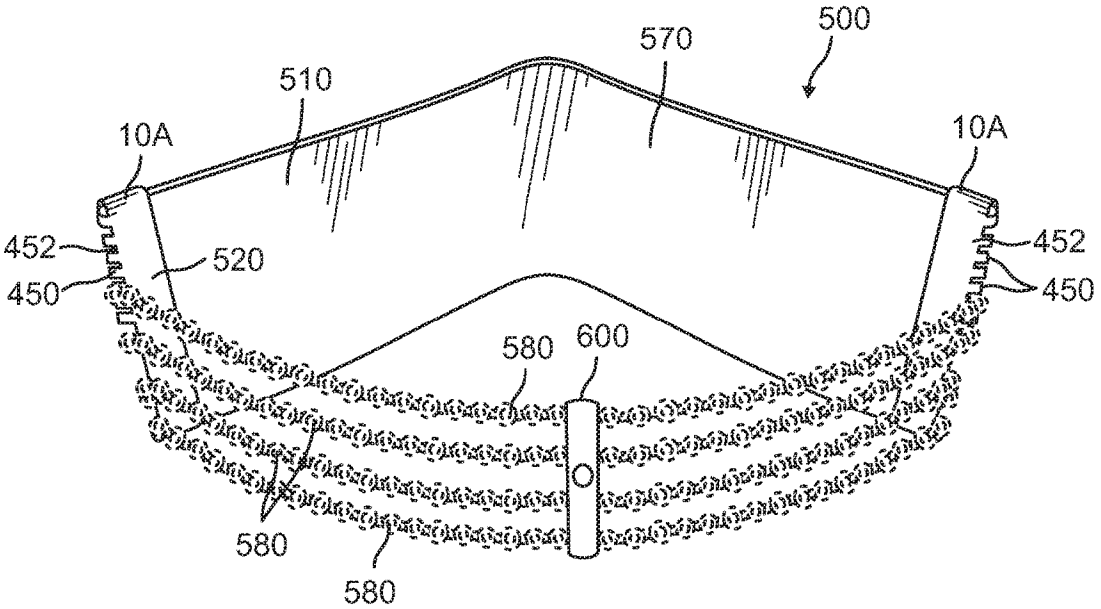
Figure 20:
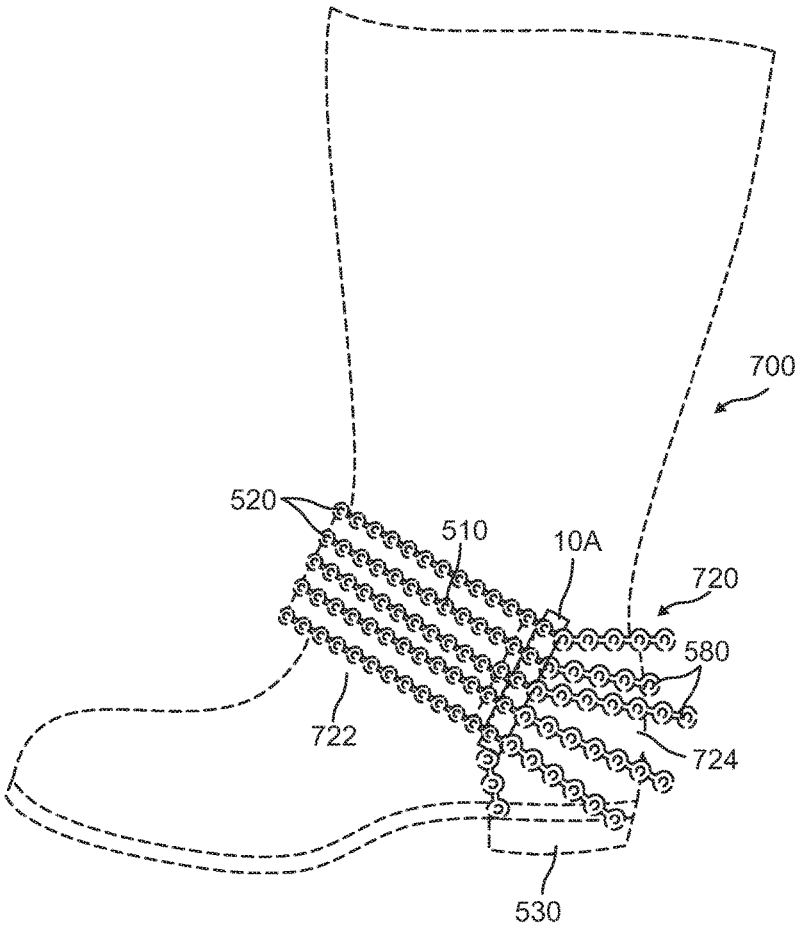
Figure 21:
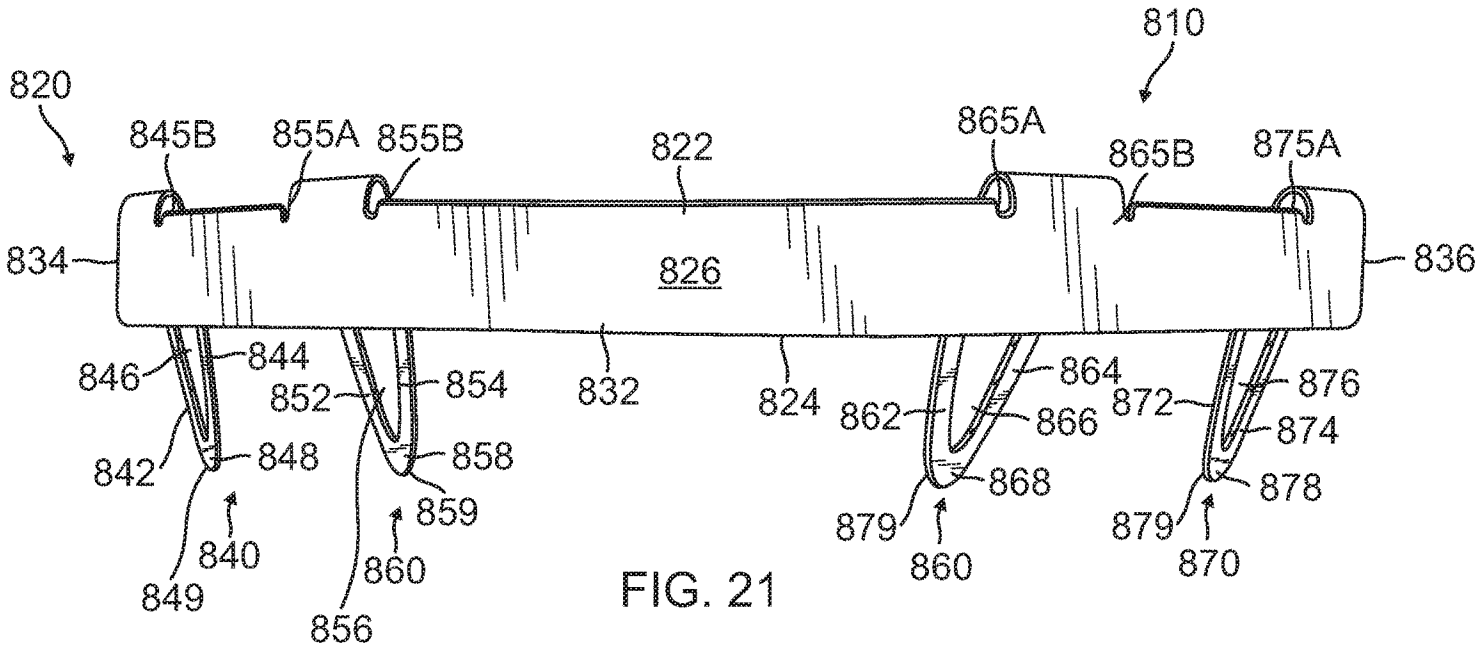
Figure 22:
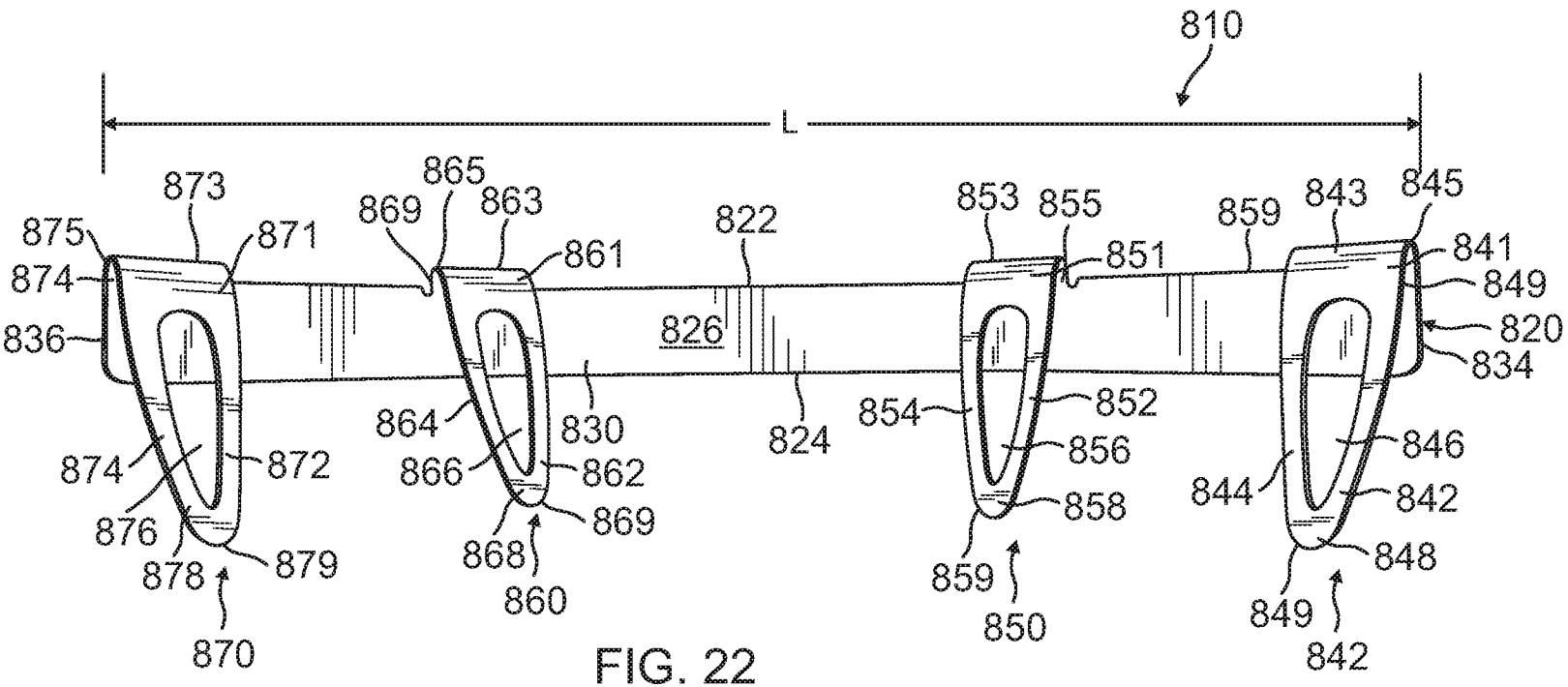
Figure 23:
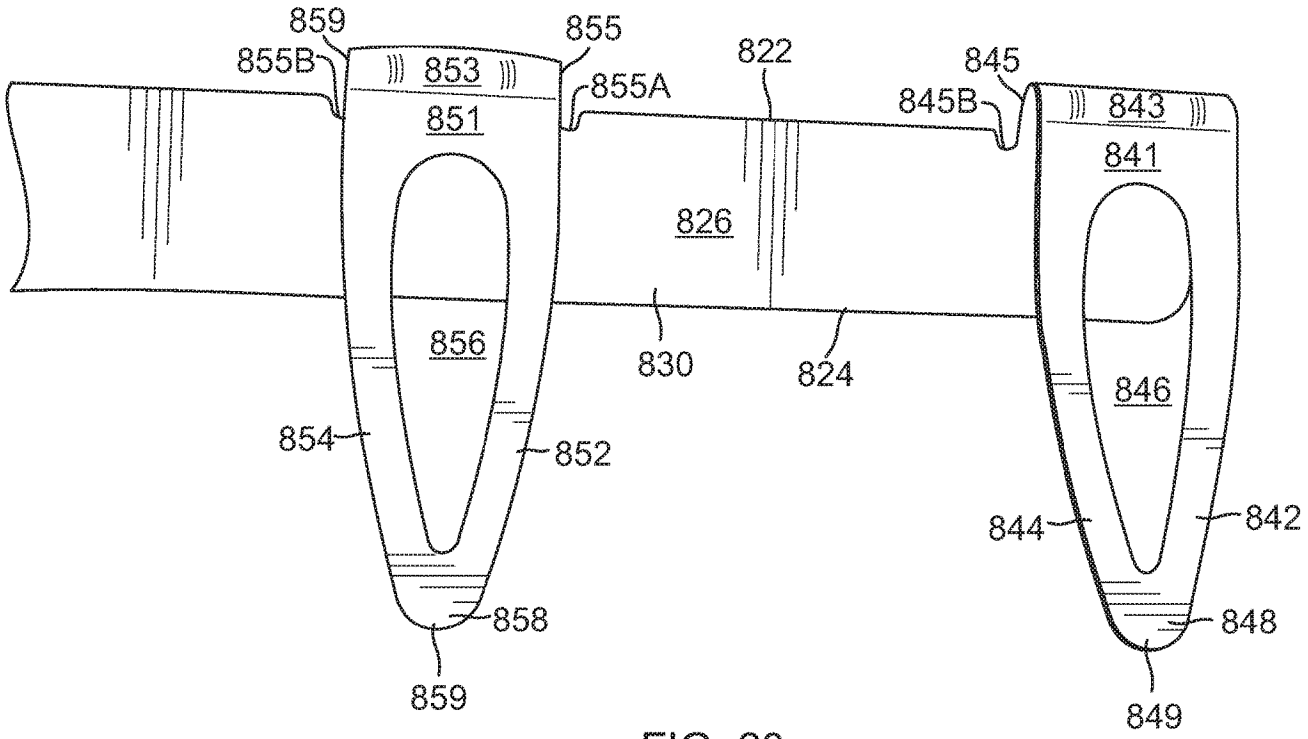
Figure 24:
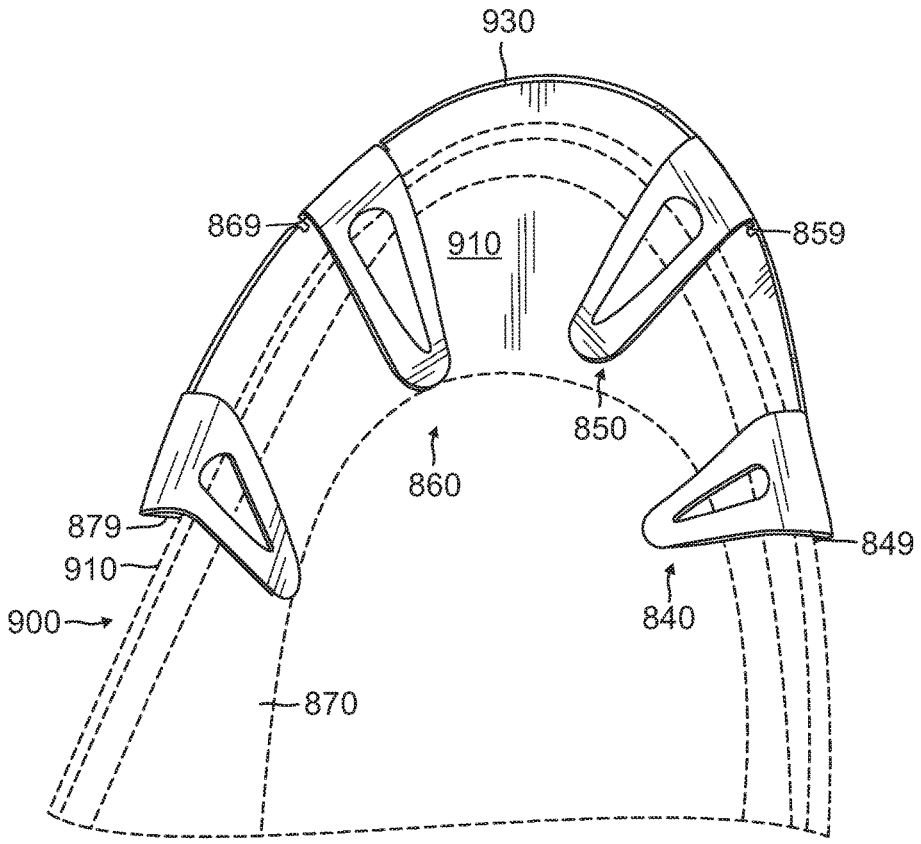
Figure 25:
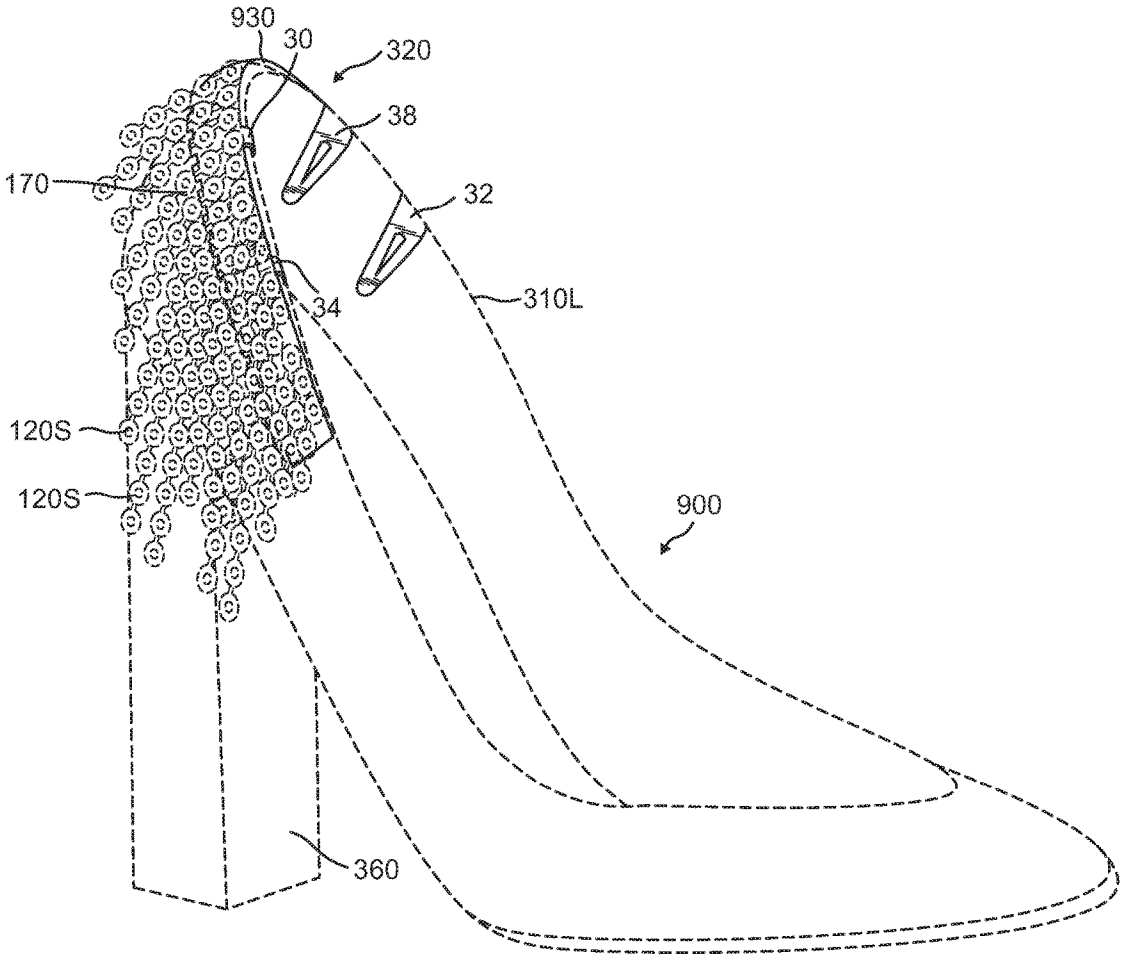

FIG. 18 is a decorative member including a fabric member having a multiplicity of rhinestone strings affixed to the rear surface with a respective one of an alternative attaching member affixed at a first end and a second end of the fabric member and rhinestones affixed to a rear face of each attaching member;

FIG. 19 is a top front view of a decorative member including a fabric member with a front face and with a respective one of an alternative attaching member affixed at a first end and a second end of the fabric member by having a first transverse tab and a second transverse tab bent and clamped around a respective end of fabric member and a multiplicity of rhinestone strings retained in respective gaps between two adjacent sets of the multiplicity of teeth;

FIG. 20 is a side perspective view of a decorative ornament retained by a pair of alternative attaching members with a respective one alternative attaching member illustrated in FIGS. 13-17, with the decorative ornament wrapped around an instep region of a boot;

FIG. 21 is a rear perspective view of the third embodiment improved bracket illustrating four spaced apart bracket retaining arms attached to the main jewelry band, also illustrating the exterior surface of the body of the main jewelry band;

FIG. 22 is a front perspective view of the third embodiment improved bracket illustrating four spaced apart bracket retaining arms attached to the main jewelry band, also illustrating the interior surface of the body of the main jewelry band;

FIG. 23 is a close-up view of two of the bracket retaining arms illustrating how they are attached to the elongated upper edge of the main jewelry band;

FIG. 24 is a top perspective view of the third embodiment improved bracket retained on the rear of a woman's shoe; and FIG. 25 is a top-side perspective view of the third embodiment improved bracket retained of the rear of a woman's shoe with one example of a decorative ornament affixed to the exterior surface of the body of the main jewelry band.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
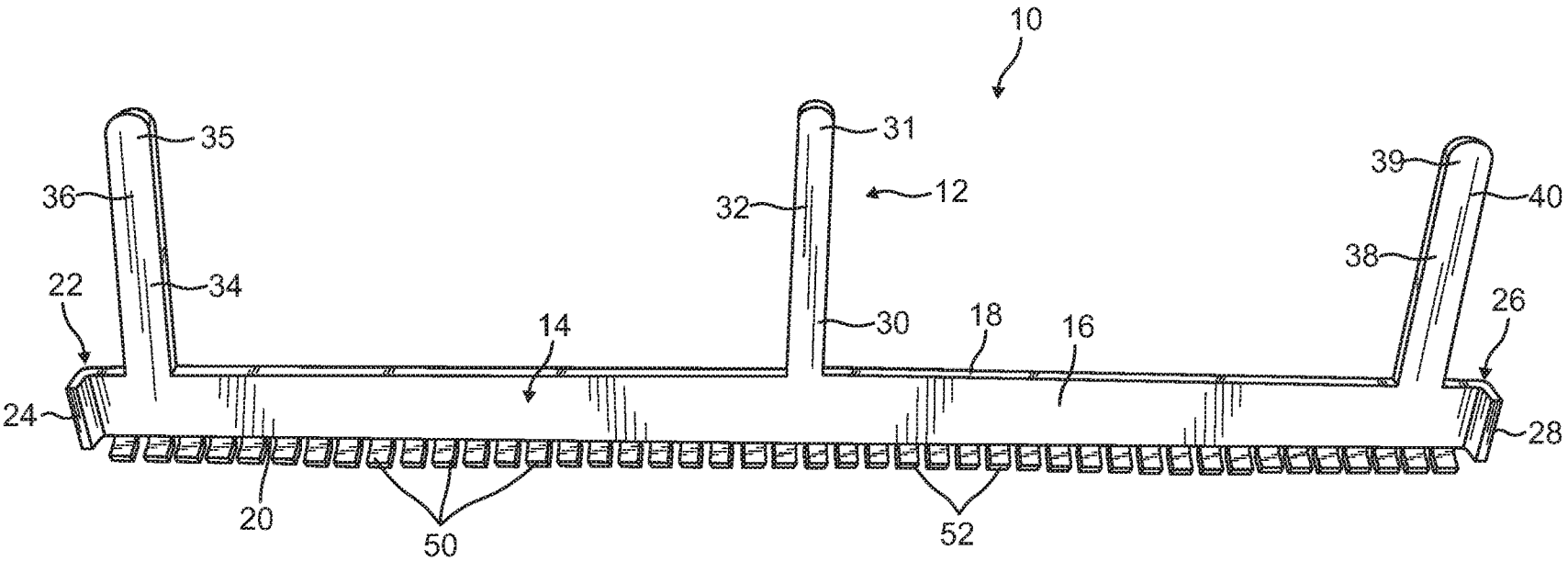
FIG. 1 is a front perspective view of an embodiment of a main attaching member and decorative ornament retaining member of the present invention, the main attaching member including an elongated flexible band having a front face, three spaced apart flexible attaching members integrally formed with the elongated flexible band and extending perpendicularly from the top longitudinal side of the elongated flexible band with one flexible attachment member at approximately a middle of the elongated flexible band with a cushioning member affixed to the front facing side of the middle flexible attachment member and two flexible attachment members respectively located adjacent a first end and a second end of the elongated flexible band (each could also have a cushioning member affixed to a respective front facing side), a multiplicity of spaced apart transverse teeth integrally formed with the elongated flexible band, each of the multiplicity of teeth separated from an adjacent tooth by a gap, the multiplicity of teeth extending perpendicularly to the elongated flexible band and located adjacent a bottom longitudinal side of the elongated flexible band, a first transverse stopping tab formed integrally with the elongated flexible band and located at the first end of the elongated flexible band and extending perpendicularly to the elongated flexible band and in the same direction of the multiplicity of teeth and a second transverse stopping tab formed integrally with the elongated flexible band and located at the second end of the elongated flexible band and extending perpendicularly to the elongated flexible band and in the same direction as the multiplicity of teeth.

Referring to FIG. 1, there is illustrated a front perspective view of an embodiment of a main attaching member and decorative ornament retaining member 10 of the present invention, the main attaching member portion 12 including an elongated flexible band 14 having a front face 16, three spaced apart flexible attaching members 30, 34 and 38 integrally formed with the elongated flexible band 14 and extending perpendicularly from the top longitudinal side 18 of the elongated flexible band 14 with one flexible attachment member 30 at approximately a middle of the elongated flexible band 14 with a cushioning member 32 affixed to the front facing side 31 of the middle flexible attachment member 30 and two flexible attachment members 34 and 38 respectively located adjacent a first end 22 and a second end 26 of the elongated flexible band 14 (each could also have a cushioning member 36 and 40 affixed to a respective front facing side 35 and 39), a multiplicity of spaced apart transverse teeth 50 integrally formed with the elongated flexible band 14 and located adjacent the bottom longitudinal side 20 of the elongated flexible band 14. Each of the multiplicity of teeth 50 separated from an adjacent tooth by a gap 52, the multiplicity of teeth 50 extending perpendicularly to the elongated flexible band 14 and located adjacent the bottom longitudinal side 20. A first transverse stopping tab 24 is integrally formed with the elongated flexible band 14 and located at the first end 22 of the elongated flexible band 14 and extending perpendicularly to the elongated flexible band 14 and in the same direction of the multiplicity of teeth 50. A second transverse stopping tab 28 is integrally formed with the elongated flexible band 14 and located at the second end 26 of the elongated flexible band 14 and extending perpendicularly to the elongated flexible band 14 and in the same direction of the multiplicity of teeth 50.

Figure 2:
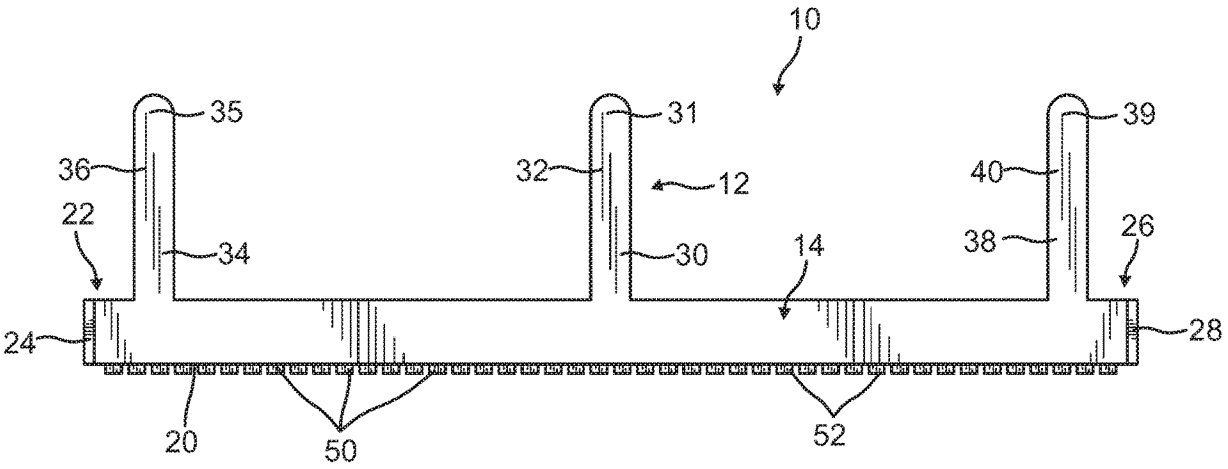
FIG. 2 is a front elevational view of the embodiment of the main attaching member illustrated in FIG. 1 and described in detail in the description of FIG. 1.

Referring to FIG. 2, there is illustrated a front elevational view of a main attaching member and decorative ornament retaining member 10 of the present invention and described in detail in the description of FIG. 1 with the parts identically numbered.

Figure 3:
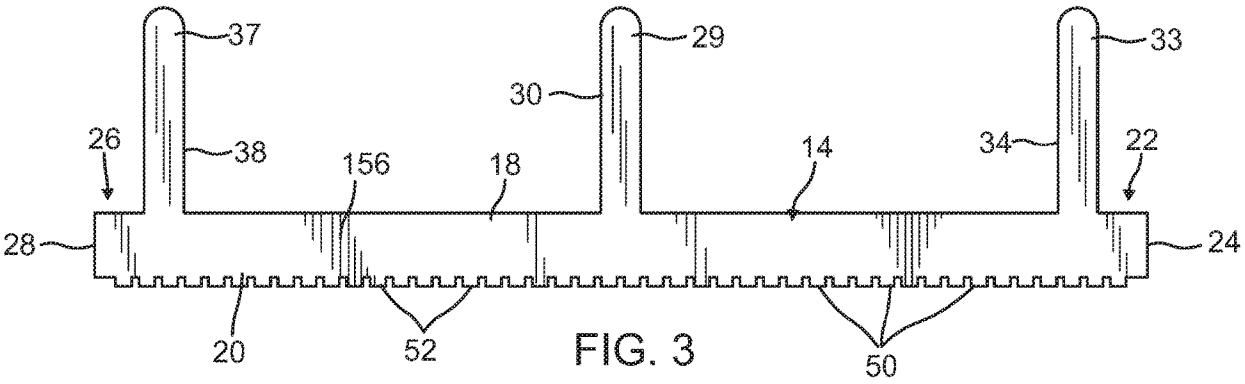
FIG. 3 is a rear elevational view of the embodiment of the main attaching member illustrated in FIG. 1 and described in detail in the description of FIG. 1.

FIG. 3 is a rear elevational view of a main attaching member and decorative ornament retaining member 10 of the present invention and described in detail in the description of FIG. 1 when viewed from the rear. The main attaching member portion 12 is affixed to s an elongated flexible band 14 having a rear face 156, three spaced apart flexible attaching members 30, 34 and 38 integrally formed with the elongated flexible band 14 and extending perpendicularly from the top longitudinal side 18 of the elongated flexible band 14 with one flexible attachment member 30 at approximately a middle of the elongated flexible band 14 and having a rear facing side 29 which can also be covered by a portion of the cushioning member 32 and also affixed to the rear facing side 29 of the middle flexible attachment member 30 and two flexible attachment members 34 and 38 respectively located adjacent a first end 22 and a second end 26 of the main attaching portion 12 of the elongated flexible band 14 (each could also have a cushioning member 36 and 40 covering and also affixed to a respective rear facing side 33 and 37). Each of the multiplicity of teeth 50 separated from an adjacent tooth by a gap 52, the multiplicity of teeth 50 extending perpendicularly to the elongated flexible band 14 and located adjacent the bottom longitudinal side 20. A first transverse stopping tab 24 is integrally formed with the elongated flexible band 14 and located at the first end 22 of the elongated flexible band 14 and extending perpendicularly to the elongated flexible band 14 and in the same direction of the multiplicity of teeth 50. A second transverse stopping tab 28 is integrally formed with the elongated flexible band 14 and located at the second end 26 of the elongated flexible band 14 and extending perpendicularly to the elongated flexible band 14 and in the same direction of the multiplicity of teeth 50.

It is also within the spirit and scope of the present invention that the respective cushioning members such as 32, 36 and 40 can only cover a portion of the respective attaching member or it can only cover a tip of the respective attaching member.

Figure 4:
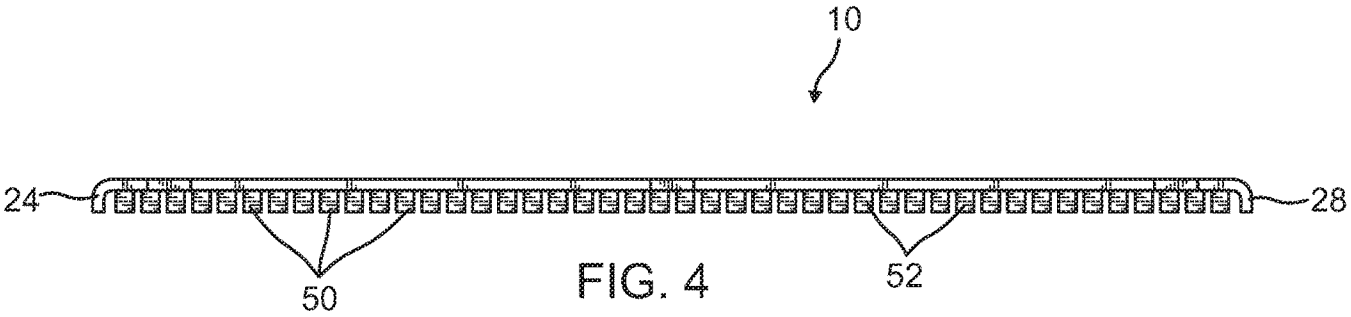
FIG. 4 is a top plan view of the embodiment of the main attaching member illustrated in FIG. 1 and described in detail in the description of FIG. 1.

Referring to FIG. 4, there is illustrated a top plan view of the embodiment of the main attaching member and decorative ornament retaining member 10 of the present invention and described in detail in the description of FIG. 1 with visible parts numbered the same. in FIG. 1 and described in detail in the description of FIG. 1.

Figure 5:
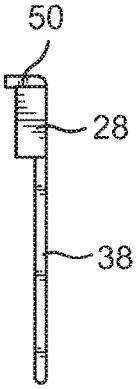
FIG. 5 is a second side elevational view of the embodiment of the main attaching member illustrated in FIG. 1 and described in detail in the description of FIG. 1, a first side elevational view being a mirror image thereof.

Referring to FIG. 5, there is illustrated a second side elevational view of the of the main attaching member and decorative ornament retaining member 10 of the present invention and described in detail in the description of FIG. 1 with visible parts numbered the same as in FIG. 1 and described in detail in the description of FIG. 1, a first side elevational view being a mirror image thereof.

Figure 6:
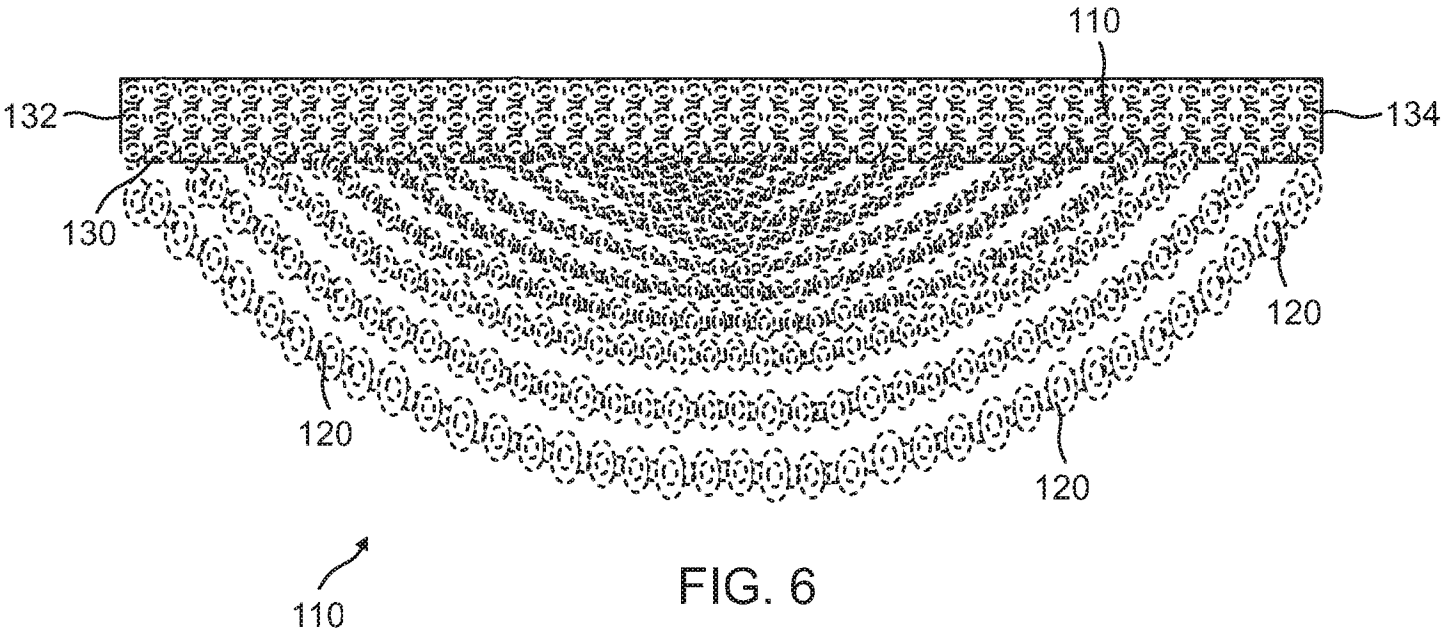
FIG. 6 is a front view of a decorative rhinestone piece before it is cut.
Figure 7:
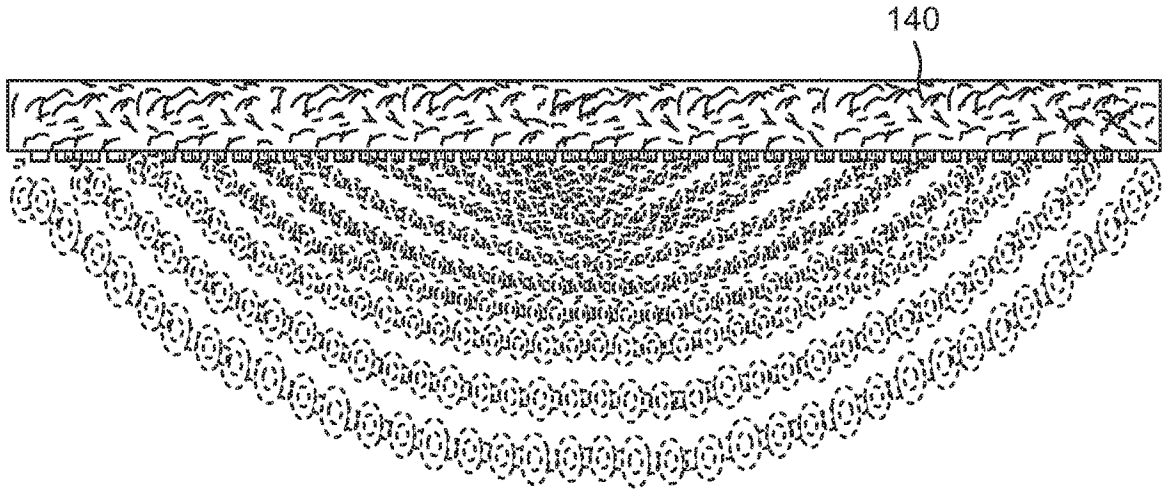
FIG. 7 is a rear view of a decorative rhinestone piece before it is cut and a material backing which will be affixed to the front face of the elongated flexible band.

Referring to FIG. 6, there is illustrated a front view of a decorative rhinestone piece 100 before it is cut. FIG. 7 is a rear view of the decorative rhinestone piece before it is cut and a material backing 140 main attaching portion of the elongated flexible band. The rhinestone piece 100 includes a rhinestone band portion 110 with a multiplicity of separate rhinestone strings 120 each respectively extending from a location adjacent a bottom longitudinal side 130 of the rhinestone band portion 110 and adjacent a first transverse end 132 to an opposite location adjacent the bottom longitudinal side 130 of the rhinestone band portion 110 and adjacent a second transverse end 134. The backing material 140 extends along and is affixed to the rear face 114 of the rhinestone band portion. The backing material 140 is affixed to the front face 18 of the elongated flexible band 14. The rhinestone strings 120 can be cut to form any desired design, one example being illustrated in the following figures. It will be appreciated that the rhinestone piece 100 is only one illustrative example of an ornamental member and any shape or style of an ornamental member is within the spirit and scope of the present invention.

Figure 8:
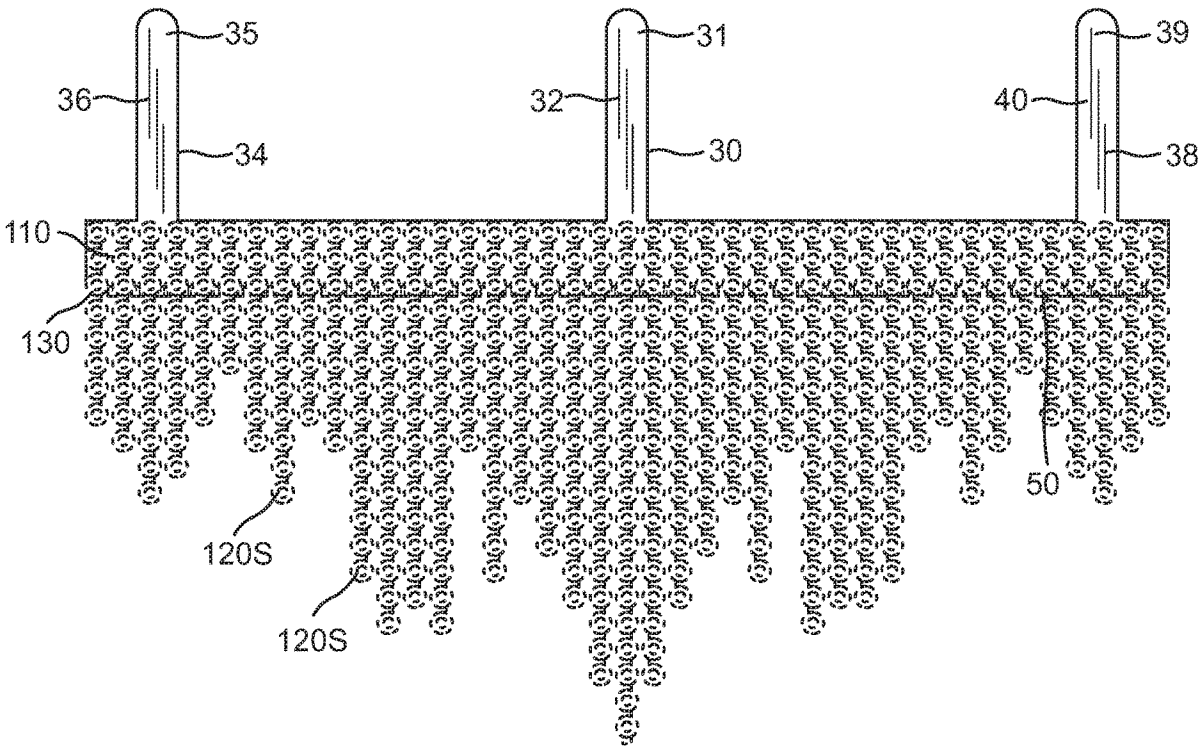
FIG. 8 is a front elevational view of one embodiment of a decorative ornament used with the present invention, the decorative ornament having a front face with rhinestones thereon and spaced apart rhinestones extending front a bottom horizontal side, the rhinestone piece illustrated in FIG. 6 affixed to the elongated flexible band and the rhinestones cut to form the decorative piece, the cushioning members affixed to the front face of the attaching members.

Referring to FIG. 8 there is illustrated a front elevational view of one embodiment of a decorative ornament 100 used with the present invention 10, the decorative ornament 10 being a rhinestone piece 170 after it has been cut to form a multiplicity of separate rhinestone strings 120S each respectively extending from a location adjacent a bottom longitudinal edge 130 of the rhinestone band portion 110. The backing material 140 affixed to the front face 18 of the elongated flexible band 14, with the separate rhinestone strings 120S hanging away from the rhinestone band portion with at least one rhinestone string located in a gap 52 between a respective two adjacent teeth of the multiplicity of teeth 50.

Figure 9:
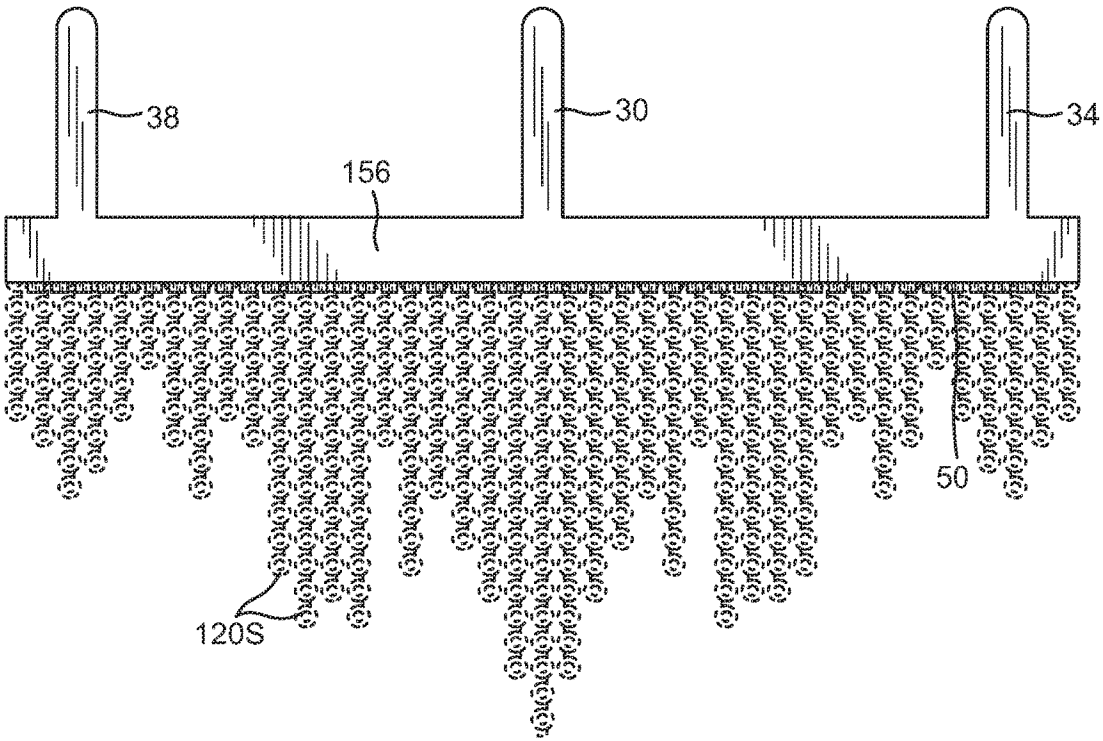
FIG. 9 is a rear elevational view of one embodiment of a decorative ornament used with the present invention with the front elevational view illustrated in FIG. 8, the decorative ornament hanging between the teeth and cut to form the decorative piece.

Referring to FIG. 9, there is illustrated the present invention 10 with the decorative ornamental rhinestone member affixed as described in FIG. 8, but viewed from the rear.

Figure 10:
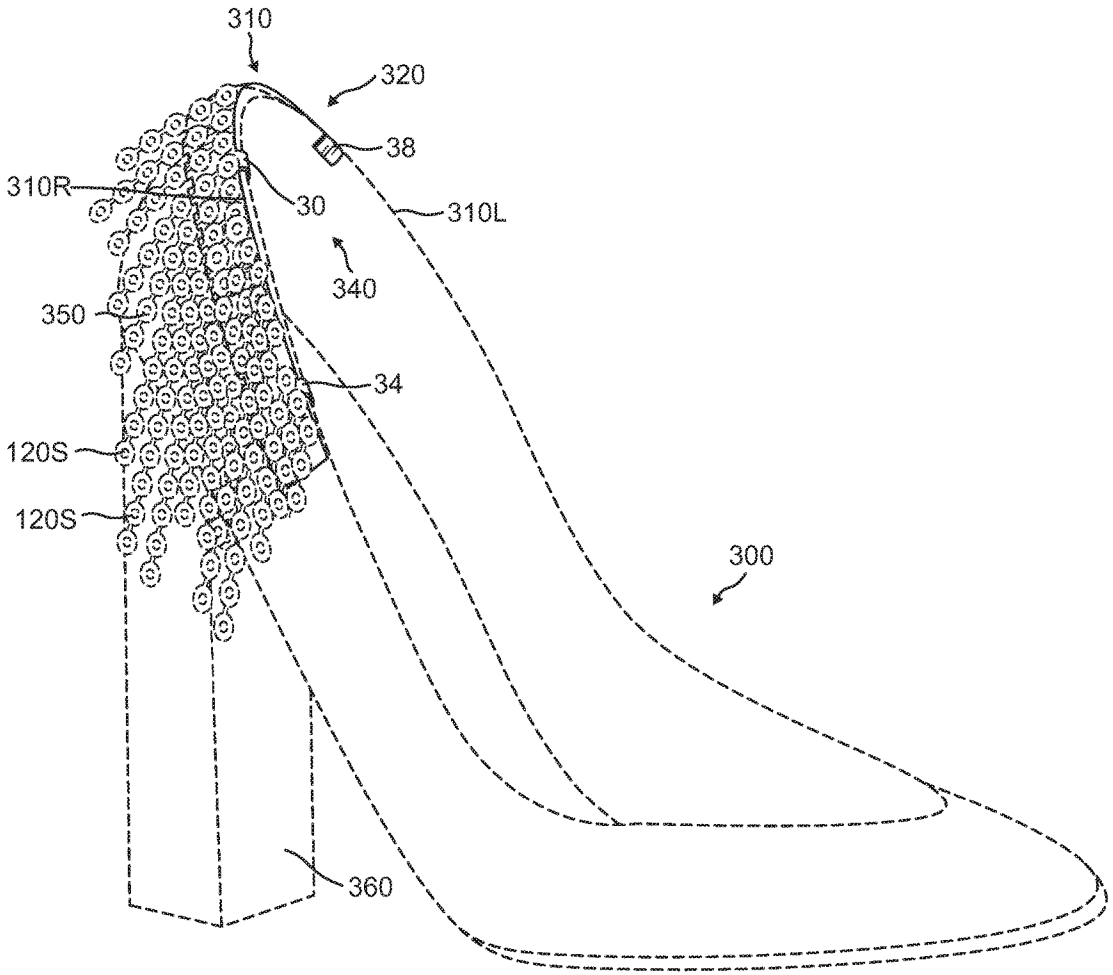
FIG. 10 is a side top perspective view of the decorative ornament illustrated in FIG. 8 with a rear surface of the front face affixed to the front surface of the elongated flexible band illustrated in FIGS. 1-5, with the extending decorative rhinestones respectively positioned within a respective gap between the teeth, with the elongated flexible band affixed around a rear end of a shoe with the flexible attachment members bent and retained against an interior surface of the shoe.
Figure 11:
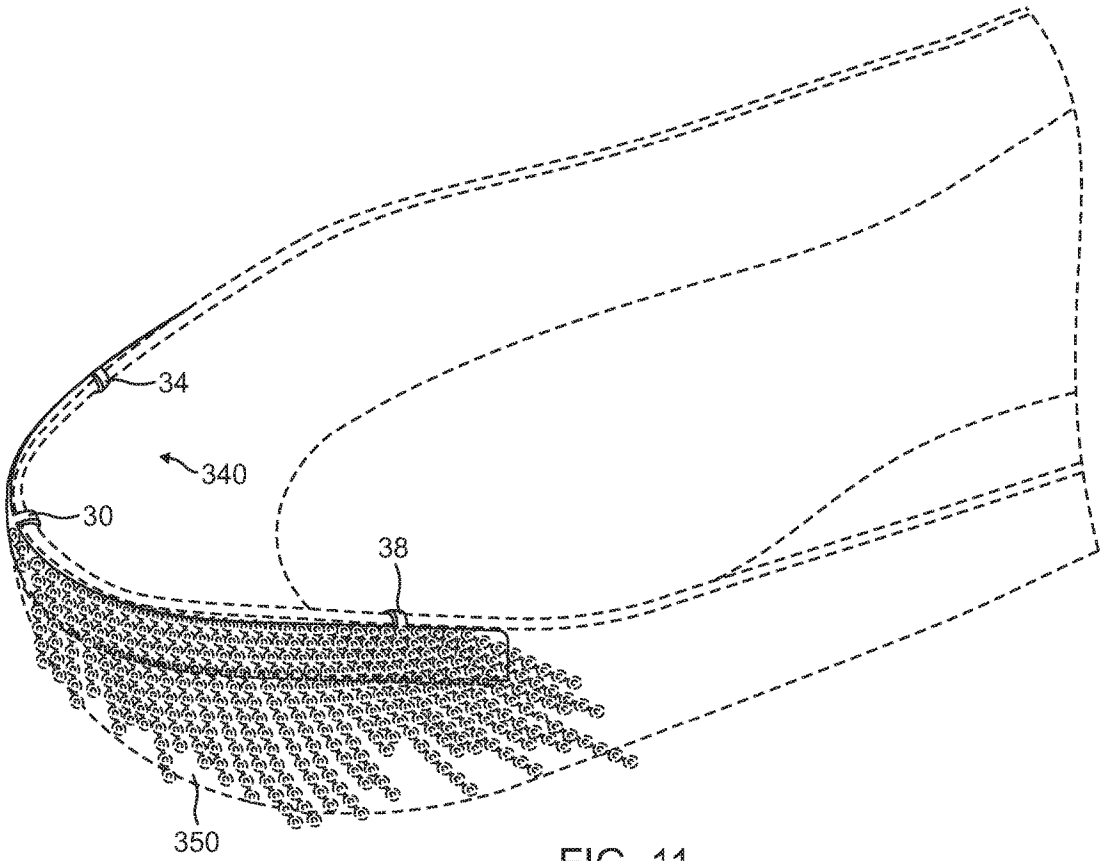
FIG. 11 is a closeup view of FIG. 10 illustrated a closeup of the side top perspective view of the decorative ornament with a rear surface of the front face affixed to the front surface of the elongated flexible band, with the extending decorative rhinestones respectively positioning within a respective gap between the teeth, with the elongated flexible band affixed around a rear end of a shoe with the flexible attachment members bent and retained against an interior surface of the shoe.

FIG. 10 is a side top perspective view of the main attaching member and decorative ornament retaining member 10 illustrated in FIGS. 8 and 9, removably affixed around a rear end of a shoe 300 with the flexible attachment members 30, 34 and 38 bent and retained over a top rear portion 320 and bent over a top rear wall 310 against a rear interior surface 340 of the shoe 300. FIG. 11 is an enlarged to perspective view. The flexible attaching members are bent over and around the top rear wall 310 of shoe 300 so that each flexible attachment member is press fit retained against the rear interior surface 340 of the shoe 300 so that the rhinestone band portion rests against the rear upper exterior surface 350 of the shoe 300 and the multiplicity of rhinestone strings attractively hang over a portion of the rear upper exterior surface 350 and a portion of the heel 360 of the shoe 300. If cushioning members are used with the attachment members 30, 34 and 38, the respective cushioning members 31, 35 and 39 serve to prevent the attachment members from irritating the rear of a foot placed within the shoe. It is within the spirit and scope of the present invention for the decorative ornament retaining member 10 to be removably or permanently affixed around any location entirely or partially around the top left side 310L or top right side 310R of the shoe 300.

Referring to FIG. 11, there is illustrated a closeup view of FIG. 10 illustrating a closeup of the side top perspective view of the present invention 10 affixed to the shoe 300 as described in FIG. 10.

Figure 12:
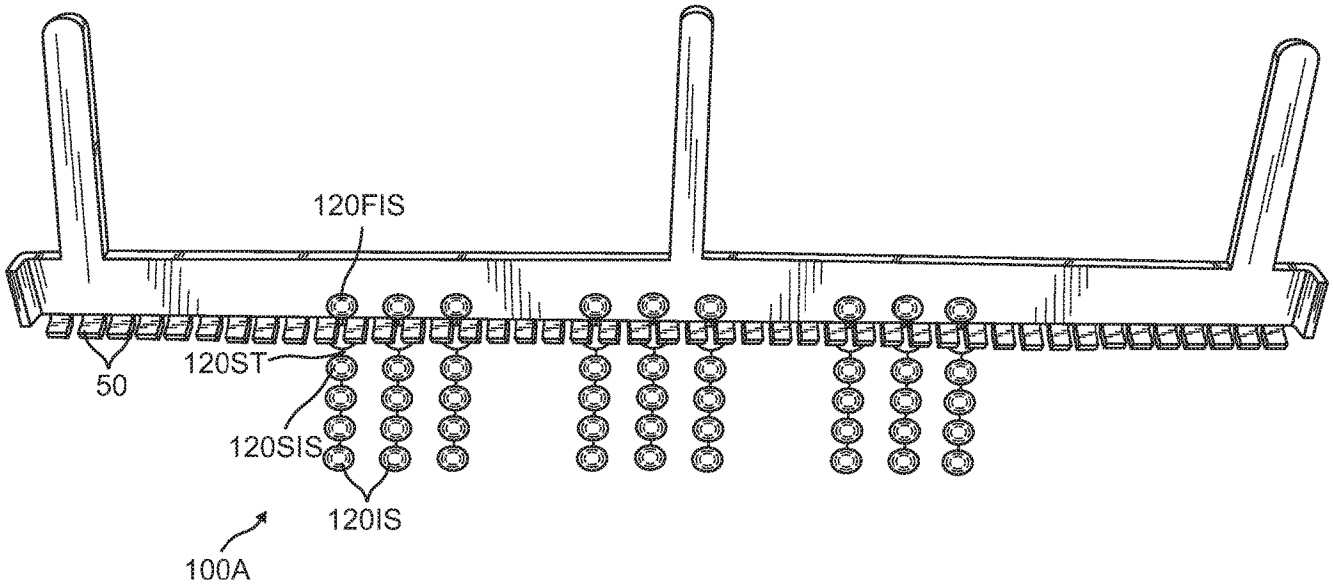
FIG. 12 is a front elevational of the elongated flexible band illustrated in FIGS. 1-5, with an alternative embodiment of a decorative ornament having individual chains of rhinestones with a respective one of a chain of rhinestones having a first rhinestone respectively affixed to the front face of the elongated band and the string between the first rhinestone and second rhinestone positioned within a respective gap between the teeth, and the remaining rhinestones in the chain dangling from beneath the teeth.

Referring to FIG. 12, there is illustrated is a front elevational of the elongated flexible band 14 illustrated in FIGS. 1 to 5 with an alternative embodiment of a decorative ornament 100A having individual chains of rhinestones 120IS with a respective one of a chain of rhinestones having a first rhinestone 120FIS respectively affixed to the front face 18 of the main attaching member portion 12 of the elongated flexible band 14 and the string 120ST between the first rhinestone 120FIS and a second rhinestone 120SIS positioned within a respective gap 52 between two adjacent teeth of the multiplicity of teeth 50, and the remaining rhinestones in the chain dangling from beneath the teeth. Each rhinestone chain can be press fit retained between two adjacent teeth or the first rhinestone 120FIS can be adhered to the front face with a bonding element such as glue.

It will be appreciated that it is within the spirit and scope of the present invention to have any ornamental member affixed to the present invention 10 with the present invention retained onto a shoe, as described. While three attachment numbers 30, 34 and 38 have been illustrated, it is within the spirit and scope of the present invention to have at least one flexible attachment member integrally formed with the elongated flexible band 14 at any location along the top longitudinal side 18. By way of example, one attachment member can be in the middle or a pair of oppositely disposed attachment members can be positioned adjacent opposite ends of the elongated flexible band 14. The present invention can be smaller to cover less of the rear surface 350 of the shoe or be can larger. The present invention is not restricted to any particular size or shape but has the fundamental innovative features as described in detail in FIGS. 1 to 5.

Figure 13:
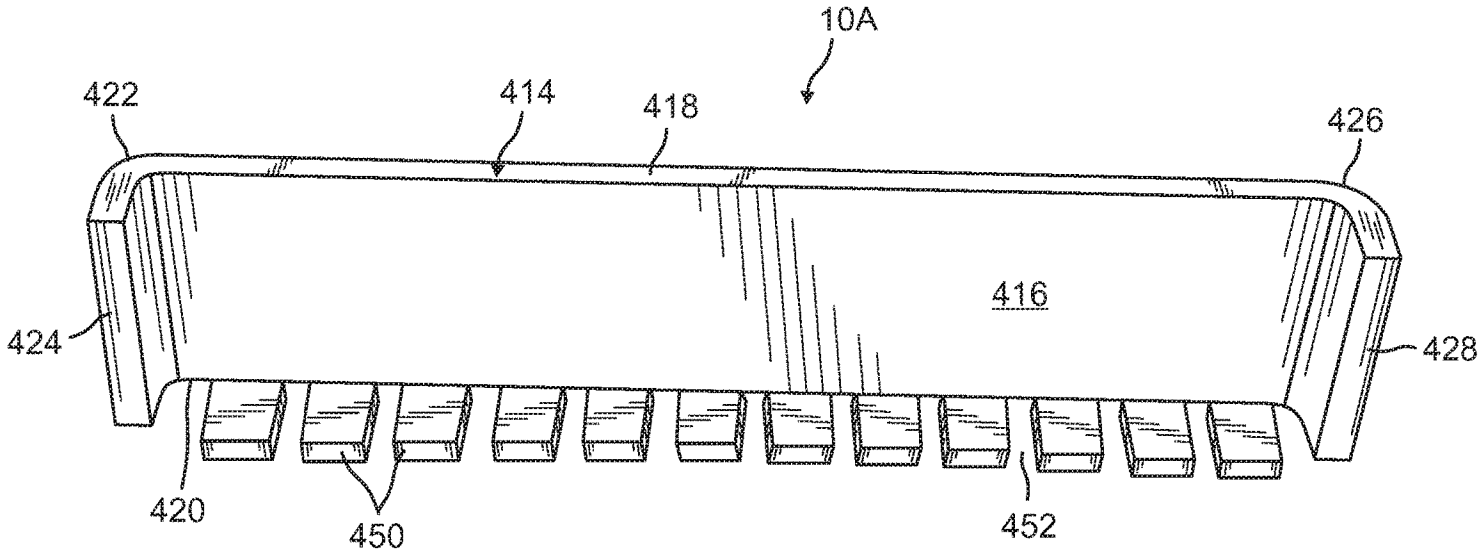
FIG. 13 is a front perspective view of an alternative embodiment of a main attaching member and decorative ornament retaining member of the present invention used with the embodiment illustrated in FIG. 18 to 20 designed to be worn around the instep region of footwear, the alternative embodiment of the main attaching member including an elongated flexible band having a front face, a multiplicity of spaced apart transverse teeth integrally formed with the elongated flexible band, each of the multiplicity of teeth separated from an adjacent tooth by a gap, the multiplicity of teeth extending perpendicularly to the elongated flexible band and located adjacent a bottom longitudinal side of the elongated flexible band, a first transverse tab functioning as an attaching member and formed integrally with the elongated flexible band and located at the first end of the elongated flexible band and extending perpendicularly to the elongated flexible band and in the same direction of the multiplicity of teeth and a second transverse tab functioning as an attaching member and formed integrally with the elongated flexible band and located at the second end of the elongated flexible band and extending perpendicularly to the elongated flexible band and in the same direction as the multiplicity of teeth.

Referring to FIG. 13, there is illustrated a front perspective view of an alternative embodiment of a main attaching member and decorative ornament retaining member 10A of the present invention used with the embodiment illustrated in FIGS. 18 to 20, designed to be worn around the instep region of footwear, the alternative embodiment of the main attaching member including an elongated flexible band 414 having a front face 416 and a top longitudinal side 418, a multiplicity of spaced apart transverse teeth 450 integrally formed with the elongated flexible band 414, each of the multiplicity of teeth 450 separated from an adjacent tooth by a gap 452, the multiplicity of teeth 450 extending perpendicularly to the elongated flexible band 414 and located adjacent a bottom longitudinal side 420 of the elongated flexible band 414, a first transverse tab 424 functioning as an attaching member and formed integrally with the elongated flexible band 414 and located at the first end 422 of the elongated flexible band 414 and extending perpendicularly to the elongated flexible band 414 and in the same direction of the multiplicity of teeth 450 and a second transverse tab 428 functioning as an attaching member and formed integrally with the elongated flexible band 414 and located at the second end of the elongated flexible band 426 and extending perpendicularly to the elongated flexible band 414 and in the same direction as the multiplicity of teeth 450.

Figure 14:
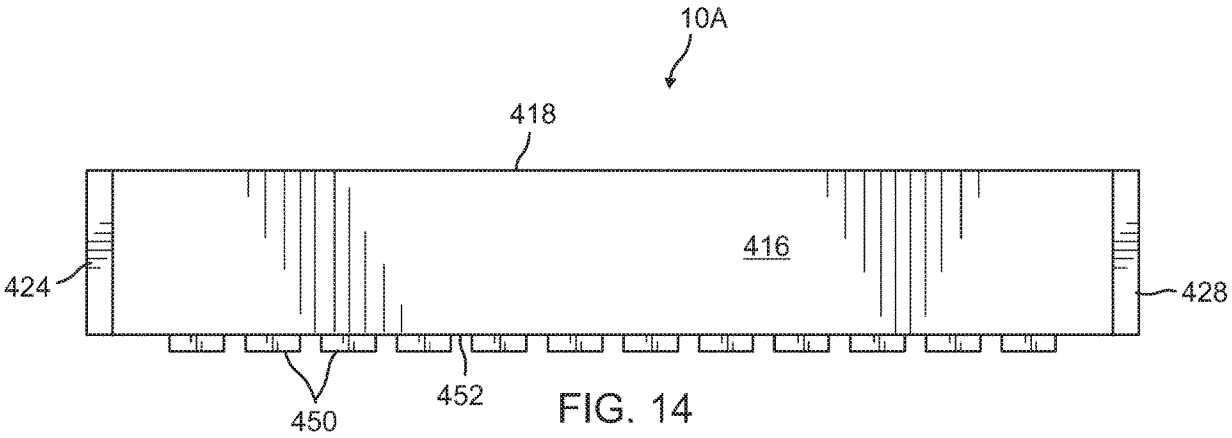
FIG. 14 is a front elevational view of the alternative embodiment of the main attaching member illustrated in FIG. 13 and described in detail in the description of FIG. 13.

Referring to FIG. 14, there is illustrated a front elevational view of the alternative embodiment of the main attaching member 10A illustrated in FIG. 13 and described in detail in the description of FIG. 13, with the parts numbered the same.

Figure 15:
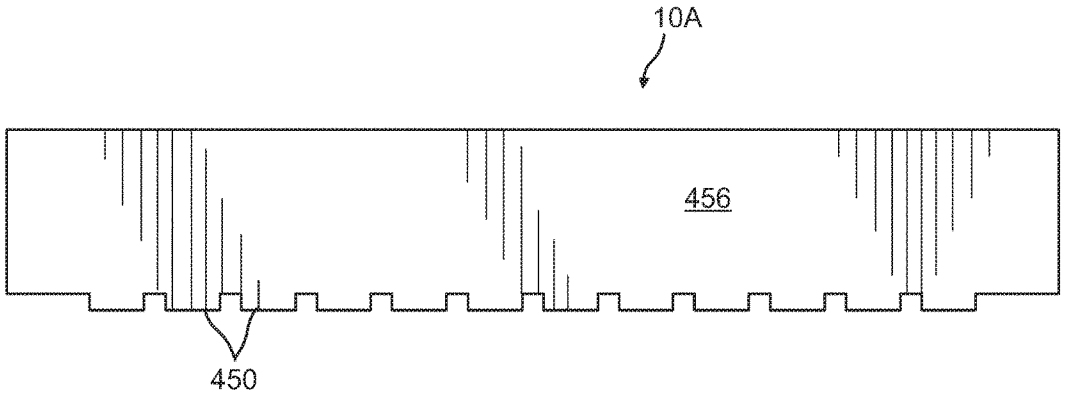
FIG. 15 is a rear elevational view of the alternative embodiment of the main attaching member illustrated in FIG. 14 and described in detail in the description of FIG. 13.

Referring to FIG. 15, there is illustrated a rear elevational view of the alternative embodiment of the main attaching member illustrated in FIG. 14 and described in detail in the description of FIG. 13 with a rear face 456 of the elongated flexible band, the parts numbered the same.

Figure 16:
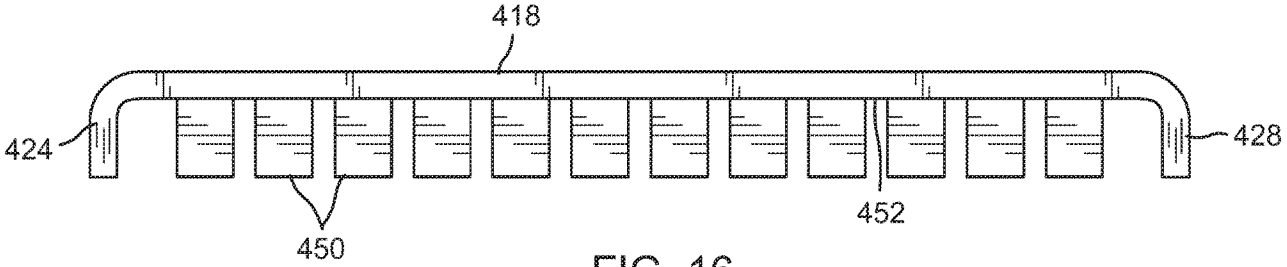
FIG. 16 is a top plan view of the alternative embodiment of the main attaching member illustrated in FIG. 13 and described in detail in the description of FIG. 13.

Referring to FIG. 16, there is illustrated a top plan view of the alternative embodiment of the main attaching member 10A illustrated in FIG. 13 and described in detail in the description of FIG. 13, with visible parts numbered the same.

Figure 17:
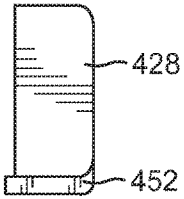
FIG. 17 is a second side elevational view of the embodiment of the main attaching member illustrated in FIG. 13 and described in detail in the description of FIG. 13, a first side elevational view being a mirror image thereof.

Referring to FIG. 17, there is illustrated a second side elevational view of the embodiment of the main attaching member illustrated in FIG. 13 and described in detail in the description of FIG. 13 with visible parts numbered the same, a first side elevational view being a mirror image thereof.

Referring to FIG. 18, there is illustrated a top front view of a decorative member 500 including a fabric member 510 having a multiplicity of rhinestone strings 520 affixed to the front surface 530 with a respective one of an alternative attaching member 10A affixed at a first end 540 and a second end 550 of the fabric member 510 and rhinestones 560 affixed to a front face 456 of each alternative attaching member 10A. The fabric member 510 is selected from the group consisting of suede, leather, leatherette, polyester, heavy cotton, wool, nylon and rayon.

Referring to FIG. 19, there is illustrated a top rear view of a decorative member 500 including a fabric member 510 with a rear face 570 and with a respective one of an alternative attaching member 10A affixed at a first end 540 and a second end 550 of the fabric member 510 by having a first transverse tab 424 and a second transverse tab 428 bent and clamped around a respective end 540 and 550 of fabric member 510. A multiplicity of rhinestone strings 580 are retained on a respective front face 416 (best illustrated in FIG. 13) of each attaching member 10A and extend in respective gaps 452 between two adjacent sets of the multiplicity of teeth 450 and extend from a first alternative attaching member 10A at first end 540 to the alternative attaching member 10A at the second end 550. A releasing member such as a clasp 600 enables the multiplicity of rhinestone strings 580 of decorative member 500 to be released.

Referring to FIG. 20 there is illustrated a side perspective view of the decorative ornament 500 retained by a pair of alternative attaching members 10A, with a respective one alternative attaching member 10A illustrated in FIGS. 13-17, with the decorative ornament wrapped around an instep region 720 of a boot 700 with the fabric member 510 and affixed rhinestones 520 at a front location 722 of the instep region 720 and the multiplicity of rhinestone strings 580 over the rear 724 of the instep region 720 and adjacent the heel 730 of the boot 700. In FIG. 20, the releasing member 600 is not shown.

Referring to FIG. 21, there is illustrated is a rear perspective view of the third embodiment improved bracket illustrating four spaced apart bracket retaining arms attached to the main jewelry band, also illustrating the exterior surface of the body of the main jewelry band. Referring to FIG. 22. there is illustrated a rear perspective view of the third embodiment improved bracket illustrating four spaced apart bracket retaining arms attached to the main jewelry band, also illustrating the interior surface of the body of the main jewelry band. Referring to FIG. 23, there is illustrated a close-up view of two of the bracket retaining arms illustrating how they are attached to the elongated upper edge of the main jewelry band.

Referring to FIGS. 21, 22 and 23, the third embodiment of the present invention is this continuation-in-part invention which is an improved main attaching member and decorative ornament retaining member defined and named in this patent application as the "bracket." The bracket 810 is formed in one piece including a main jewelry band 820 having any desired given length "L" from one inch to six inches, an elongated upper edge 822, an elongated lower edge 824, and a body 826 between the elongated upper edge 822 and the elongated lower edge 824. The body 826 of the main jewelry band 820 also has an interior surface 830 and an exterior surface 832, a first end 834 and a second end 836. The continuation-in-part third embodiment improved invention which is the improved bracket 810 further includes a multiplicity of bracket retaining arms 840, 850, 860 and 870. It is within the spirit and scope of the present invention to have at least two bracket retaining arms and as many as twelve bracket retaining arms, although four bracket retaining arms 840, 850, 860 and 870 is a preferred number. Each respective bracket retaining arm 840, 850, 860 and 870 is formed in a shape of a downwardly pointing member ending in a rounded tip with a "V"-shaped gap 846, 856, 866 and 876 respectively between the respective legs 842 and 844, 852 and 854, 862 and 864, and 872 and 874 of each respective bracket retaining arm 840, 850, 860 and 870, the "V"-shaped gap extending for anywhere between 20 percent and 80 percent of the distance between the legs. The respective legs 842 and 844, 852 and 854, 862 and 864, and 872 and 874 come together and form a combined structure 848, 858, 868 and 878 leading to the lowermost rounded tip 849, 859, 869 and 879.

At its upper end, the respective legs 842 and 844, 852 and 854, 862 and 865, and 872 and 874, are combined with a respective upper transverse joining section 841, 851, 861 and 871. The respective upper transverse joining section 841, 851, 861 and 871 is integrally formed with a respective horizontal joining section 843, 853, 863 and 873 which is integrally formed with a respective downwardly extending section 845, 855, 865 and 875 which in turn is respectively integrally formed with the main jewelry band 820 at a location which extends from the lengthwise upper edge 822 of the main jewelry band 820 into a portion of the body 826 of the main jewelry band 820. Therefore, a respective transverse gap 849, 859, 869 and 879 is formed beneath each respective horizontal joining section 843, 853, 863 and 873. There is also a respective gap 855A and 855B, 865A and 865B between each end of the respective interior downwardly extending sections 855 and 865 and the lengthwise upper edge 822 and body 826 of the main band jewelry section 820. For the bracket retaining arms 840 and 870 at the ends of the body 826, downwardly extending section 845 is aligned with the first end 834 of the body 826 of the main jewelry band 820 with a gap 845B adjacent its interior side and downwardly extending section 875 is aligned with the second end 836 of the body 826 of the main jewelry band 820 with a gap 875A adjacent its interior side.

FIG. 24 is a top perspective view of the third embodiment improved bracket retained on the rear of a woman's shoe. FIG. 25 is a top-side perspective view of the third embodiment improved bracket retained of the rear of a woman's shoe with one example of a decorative ornament affixed to the front or exterior surface of the body of the main jewelry band.

Referring to FIGS. 24 and 25, the bracket retaining arms 840, 850, 860 and 870 retain the improved bracket 820 around the back 910 of a shoe 900. It is within the spirit and scope of the present invention for the entire bracket section to be formed out of plastic or metal, with spring steel being the preferred metal. Each respective generally "V"-shaped gap between respective legs of each respective bracket retaining arm enhances the flexibility of each bracket retaining arm so it can fit inside a shoe in a secure way. It is within the spirit and scope of the present invention for the bracket retaining arm to be coated with resin to prevent abrasion to a woman's foot and/or heel.

In operation, the present invention improved bracket 810 is inserted with the interior surface 830 of the body 826 of the main jewelry band 820 placed around the back surface 910 of a woman's shoe 900. Each respective bracket retaining arm 840, 850, 860 and 870 is placed into the interior surface 920 opposite to the back surface 910 of the woman's shoe 900 by having each bracket retaining arm inserted over the top edge 930 of the of the woman's shoe 900 between the back surface 910 and the interior surface 920 so that the interior surface 830 of the body 826 of the main jewelry band 820 rests against the back surface 910 of the shoe 900 and each respective bracket retaining arm 840, 850, 860 and 870 is inserted such that each of the integrally formed bracket retaining arm is inserted within the woman's shoe so that the top edge 930 of the woman's shoe 900 is retained in each respective transverse gap 849, 859, 869 and 879 gap. A portion of each integrally formed downwardly extending section 845, 855, 865 and 875 also forms a portion of each respective transverse gap 849, 859, 869 and 879 so that the top edge 930 of the rear portion of the woman's shoe 900 is trapped within each respective transverse gap 849, 859, 869 and 879 and each of the bracket retaining arms 840, 850, 860 and 870 is either press fit retained or bent against the interior surface 930 of the shoe 900 to accommodate the specific thickness of the rear portion of the woman's shoe 900 between the back exterior surface 920 and interior surface 930. The shoe also has a heel 950. In one example, the bracket retaining arms are inserted so that there are two on opposite sides of the woman's shoe spaced approximately 30 degrees apart. The respective bracket retaining arm legs with the gap between each pair of legs enables the legs to be bent against the interior surface 930 of the shoe 900 to securely fasten the bracket 810 to the shoe 900.

The remaining innovations which contain the designs of the jewelry elements are affixed to the exterior surface 832 of the body 826 of the main jewelry band 820 by adhesive or other appropriate retaining members including mating hook and loop fasteners. Examples of how decorative ornaments are retained are discussed in FIGS. 6, 7 and 8 which is repeated here but as applied to the bracket 810.

Referring to FIG. 6, there is illustrated a front view of a decorative rhinestone piece 100 before it is cut. FIG. 7 is a rear view of the decorative rhinestone piece before it is cut and a material backing 140 main attaching portion of the elongated flexible band. The rhinestone piece 100 includes a rhinestone band portion 110 with a multiplicity of separate rhinestone strings 120 each respectively extending from a location adjacent a bottom longitudinal side 130 of the rhinestone band portion 110 and adjacent a first transverse end 132 to an opposite location adjacent the bottom longitudinal side 130 of the rhinestone band portion 110 and adjacent to a second transverse end 134. The backing material 140 extends along and is affixed by an affixation member such as adhesive to the exterior surface 832 of the body 826 of the main jewelry band 820. The rhinestone strings 120 can be cut to form any desired design, one example being illustrated in the following figures. It will be appreciated that the rhinestone piece 100 is only one illustrative example of an ornamental member and any shape or style of an ornamental member is within the spirit and scope of the present invention.

Referring to FIG. 8, there is illustrated a front elevational view of one embodiment of a decorative ornament 100 used with the improved bracket 810, the decorative ornament 10 being a rhinestone piece 170 after it has been cut to form a multiplicity of separate rhinestone strings 120S each respectively extending from a location adjacent a bottom longitudinal edge 130 of the rhinestone band portion 110. The backing material 140 affixed to the exterior surface 832 of the body of the main jewelry band 820, with the separate rhinestone strings 120S hanging away from the rhinestone band portion Referring to FIG. 23, there is illustrated the present invention bracket 810 with the decorative ornamental rhinestone member affixed thereto, the bracket 810 affixed to a shoe 900 as previously described. The present invention bracket 810 retaining the decorative ornament on a woman's shoe is illustrated in FIGS. 24 and 25.

The present invention is defined in detail as an apparatus adapted for use with a decorative ornament and also adapted for use with a shoe, the apparatus comprising: (a) a bracket 810 is formed in one piece including a main jewelry band 820 having a given length "L", an elongated upper edge 822, an elongated lower edge 824, and a body 826 between the elongated upper edge 822 and the elongated lower edge 824, the body 826 of the main jewelry band 820 also having an interior surface 830 and an exterior surface 832, a first end 834 and a second end 836; (b) four bracket retaining arms 840, 850, 860 and 870, each respective bracket retaining arm 840, 850, 860 and 870 is formed in a shape of a downwardly pointing member ending in a rounded tip 849, 859, 869 and 879 with a "V"-shaped gap 846, 856, 866 and 876 respectively between respective legs 842 and 844, 852 and 854, 862 and 864, and 872 and 874 of each downwardly pointing member, each of the respective legs 842 and 844, 852 and 854, 862 and 864, and 872 and 874 come together and form a combined structure 848, 858, 868 and 878 leading to the lowermost point 849, 859, 869 and 879; (c) the respective legs 842 and 844, 852 and 854, 862 and 865, and 872 and 874, are each respectively combined at an upper location opposite the lowermost tip with a respective upper transverse joining section 841, 851, 861 and 871, each respective upper transverse joining section 841, 851, 861 and 871 is integrally formed with a respective horizontal joining section 843, 853, 863 and 873 which is integrally formed with a respective downwardly extending section 845, 855, 865 and 875 which in turn is respectively integrally formed with the main jewelry band 820 at a location which extends from the lengthwise upper edge 822 of the main jewelry band 820 into a portion of the body 826 of the main jewelry band 820, a respective transverse gap 849, 859, 869 and 879 is formed beneath each respective horizontal joining section 843, 853, 863 and 873 and each respective downwardly extending section 845, 855, 865 and 875; (d) a decorative ornament adapted for use with said bracket 810, the decorative ornament is a rhinestone piece 100 including a rhinestone band portion 110 with a multiplicity of separate rhinestone strings 120 each respectively extending from a location adjacent a bottom longitudinal side 130 of the rhinestone band portion 110 and adjacent a first transverse end 132 to an opposite location adjacent the bottom longitudinal side 130 of the rhinestone band portion 110 and adjacent a second transverse end 134, a backing material 140 extends along and is affixed by an affixation member to the exterior surface 832 of the body 826 of the main jewelry band 820; (e) the bracket 810 is adapted for use with a shoe wherein the bracket is inserted with the interior surface 830 of the body 826 of the main jewelry band 820 placed around a back surface 910 of the shoe 900, each respective bracket retaining arm 840, 850, 860 and 870 is placed into an interior surface 920 opposite to the back surface 910 of the shoe 900 by having each bracket retaining arm inserted over a top edge 930 of the of the shoe 900 between the back surface 910 and the interior surface 920 so that the interior surface 830 of the body 826 of the main jewelry band 820 rests against the back surface 910 of the shoe 900 and each respective bracket retaining arm 840, 850, 860 and 870 is inserted such that each of the integrally formed bracket retaining arms is inserted within the shoe so that a rear top edge 930 of the woman's shoe 900 is retained in each respective transverse gap 849, 859, 869 and 879 gap so that the top edge 930 of the rear portion of the woman's shoe 900 is trapped within each respective transverse gap 849, 859, 869 and 879 and each of the downwardly pointing members with a rounded tip and generally "V"-shaped gap between respective legs of the bracket retaining arms 840, 850, 860 and 870 are bent to accommodate the specific thickness of the rear portion of the woman's shoe 900 between the back exterior surface 920 and interior surface 930; and (f) wherein the rhinestone band hangs downwardly along the back surface 910 of the shoe 900.

Defined more broadly, the present invention is an apparatus adapted for use with a decorative ornament and also adapted for use with a shoe, the apparatus comprising: (a) a bracket 810 is formed in one piece including a main jewelry band 820 having ad given length "L", an elongated upper edge 822, an elongated lower edge 824, and a body 826 between the elongated upper edge 822 and the elongated lower edge 824, the body 826 of the main jewelry band 820 also having an interior surface 830 and an exterior surface 832, a first end 834 and a second end 836; (b) at least two bracket retaining arms 840, and 870, each respective bracket retaining arm 840, and 870 is formed in a shape of a downwardly pointing member ending in a rounded tip 849 and 879 with a "V" gap 846 and 876 with a respective gap 846 and 876 respectively between respective legs 842 and 844, and 872 and 874 of the "V", each of the respective legs 842 and 844, and 872 and 874 come together and form a combined structure 848 and 878 leading to the lowermost point 849 and 879; (c) the respective legs 842 and 844, 872 and 874, are each respectively combined at an upper location opposite the lowermost tip with a respective upper transverse joining section 841 and 871, the respective upper transverse joining section 841 and 871 is integrally formed with a respective horizontal joining section 843 and 873 which is integrally formed with a respective downwardly extending section 845 and 875 which in turn is respectively integrally formed with the main jewelry band 820 at a location which extends from the lengthwise upper edge 822 of the main jewelry band 820 into a portion of the body 826 of the main jewelry band 820, a respective transverse gap 849 and 879 is formed beneath at least each respective horizontal joining section 843 and 873; and (d) a decorative ornament adapted for use with said bracket, and affixed to the exterior surface 832 of the body 826 of the main jewelry band 820.

Of course the present is not intended to be restricted to any particular form or arrangement, or any specific embodiment or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. An apparatus adapted for use with a decorative ornament and also adapted for use with a shoe, the apparatus comprising:

a. a bracket is formed in one piece including a main jewelry band 820 having a given length "L", an elongated upper edge, an elongated lower edge, and a body between the elongated upper edge and the elongated lower edge, edge, the body 826 of the main jewelry band also having an interior surface and an exterior surface, a first end and a second end;

b. four bracket retaining arms and each respective bracket retaining arm are formed in a shape of a downwardly pointing member ending in a rounded tip with a "V"-shaped gap respectively between respective legs of each downwardly pointing member, each of the respective legs come together and form a combined structure leading to the lowermost point;

c. the respective legs are each respectively combined at an upper location opposite the lowermost tip with a respective upper transverse joining section, each respective upper transverse joining section is integrally formed with a respective horizontal joining section which is integrally formed with a respective downwardly extending section which in turn is respectively integrally formed with the main jewelry band at a location which extends from the lengthwise upper edge of the main jewelry band into a portion of the body of the main jewelry band a respective transverse gap is formed beneath each respective horizontal joining section and each respective downwardly extending section;

d. a decorative ornament adapted for use with said bracket, the decorative ornament is a rhinestone piece including a rhinestone band portion with a multiplicity of separate rhinestone strings each respectively extending from a location adjacent a bottom longitudinal side of the rhinestone band portion and adjacent a first transverse end to an opposite location adjacent the bottom longitudinal side of the rhinestone band portion and adjacent a second transverse end, a backing material extends along and is affixed by an affixation member to the exterior surface of the body of the main jewelry band; and e. the bracket is adapted for use with a shoe wherein the bracket is inserted with the interior surface of the body of the main jewelry band placed around a back surface of the shoe, each respective bracket retaining arm is placed into an interior surface opposite to the back surface of the shoe by having each bracket retaining arm inserted over a top edge of the shoe between the back surface and the interior surface so that the interior surface of the body of the main jewelry band rests against the back surface of the shoe and each respective bracket retaining arm is inserted such that each of the integrally formed bracket retaining arms is inserted within the shoe so that a rear top edge of the woman's shoe is retained in each respective transverse gap gap so that the top edge of the rear portion of the woman's shoe is trapped within each respective transverse gap and each of the downwardly pointing members with a rounded tip and generally "V"-shaped gap between respective legs of the bracket retaining arms are bent to accommodate the specific thickness of the rear portion of the woman's shoe between the back exterior surface and interior surface;

f. wherein the rhinestone band hangs downwardly along the back surface 910 of the shoe 900.

2. The apparatus in accordance with claim 1, further comprising the bracket is entirely made out of material selected from the group consisting of plastic and metal.

3. The apparatus in accordance with claim 2, further comprising: each bracket retaining arm is coated with resin.

4. The apparatus in accordance with claim 1 further comprising: a respective gap between each end of the respective interior downwardly extending sections and the lengthwise upper edge and body of the main band jewelry section for the bracket retaining arms at the ends of the body, downwardly extending section is aligned with the first end of the body of the main jewelry band with a gap adjacent its interior side and downwardly extending section is aligned with the second end of the body of the main jewelry band with a gap adjacent its interior side.

5. The apparatus in accordance with claim 1, further comprising: the rhinestone band portion is cut to form a multiplicity of separate rhinestone strings each respectively extending from a location adjacent a bottom longitudinal edge of the rhinestone band portion, the backing material affixed to the front face of the main jewelry band, with the separate rhinestone strings hanging away from the rhinestone band portion.

6. An apparatus adapted for use with a decorative ornament and also adapted for use with a shoe, the apparatus comprising:

a. a bracket is formed in one piece including a main jewelry band having a given length "L", an elongated upper edge, an elongated lower edge, and a body between the elongated upper edge and the elongated lower edge, the body of the main jewelry band also having an interior surface and an exterior surface, a first end and a second end;

b. at least two bracket retaining arms arms, each respective bracket retaining arm is formed in a shape of a downwardly pointing member ending in a rounded tip with a "V" gap with a respective gap respectively between respective legs of the "V", each of the respective legs come together and form a combined structure leading to the lowermost point;

c. the respective legs are each respectively combined at an upper location opposite the lowermost tip with a respective upper transverse joining section, the respective upper transverse joining section is integrally formed with a respective horizontal joining section which is integrally formed width a respective downwardly extending section which in turn is respectively integrally formed with the main jewelry band at a location which extends from the lengthwise upper edge of the main jewelry band into a portion of the body of the main jewelry band, a respective transverse gap is formed beneath at least each respective horizontal joining section; and d. a decorative ornament adapted for use with said bracket, and affixed to the exterior surface of the body of the main jewelry band.

7. The apparatus in accordance with claim 6, further comprising: the decorative ornament is a rhinestone piece including a rhinestone band portion with a multiplicity of separate rhinestone strings each respectively extending from a location adjacent a bottom longitudinal side of the rhinestone band portion and adjacent a first transverse end to an opposite location adjacent the bottom longitudinal side of the rhinestone band portion and adjacent a second transverse end, a backing material extends along and is affixed by an affixation member such as adhesive to the exterior surface of the body of the main jewelry band.

8. The apparatus in accordance with claim 6, further comprising:

a. the bracket is inserted with the interior surface of the body of the main jewelry band placed around a back surface of the shoe shoe, each respective bracket retaining arm is placed into an interior surface opposite to the back surface of the shoe by having each bracket retaining arm inserted over a top edge of the of the shoe between the back surface and the interior surface so that the interior surface of the body of the main jewelry band rests against the back surface of the shoe and each respective bracket retaining arm is inserted such that each of the integrally formed bracket retaining arms is inserted within the shoe so that a rear top edge of the woman's shoe is retained in each respective transverse gap so that the top edge of the rear portion of the woman's shoe is trapped within each respective transverse gap and each of the "V"-shaped bracket retaining arms are bent to accommodate the specific thickness of the rear portion of the woman's shoe between the back exterior surface and interior surface; and b further, whereby the rhinestone band hangs downwardly along the back surface of the shoe.

9. The apparatus in accordance with claim 6, further comprising the bracket is entirely made out of material selected from the group consisting of plastic and metal.

10. The apparatus in accordance with claim 6, further comprising: each bracket retaining arm is coated with resin.

11. The apparatus in accordance with claim 6, further comprising: for bracket retaining arms at the ends of the body, downwardly extending section is aligned with the first end of the body of the main jewelry band with a gap adjacent its interior side and downwardly extending section is aligned with the second end of the body of the main jewelry band with a gap adjacent its interior side.

12. The apparatus in accordance with claim 6, further comprising: the rhinestone band portion is cut to form a multiplicity of separate rhinestone strings each respectively extending from a location adjacent a bottom longitudinal edge 130 of the rhinestone band portion, the backing material affixed to the front face of the main jewelry band, with the separate rhinestone strings hanging away from the rhinestone band portion.

* * * * *